US009364089B1

(12) United States Patent
Chen et al.

(10) Patent No.: US 9,364,089 B1
(45) Date of Patent: Jun. 14, 2016

(54) SELF-CLOSING SLIDE RAIL ASSEMBLY WITH DECELERATION MECHANISM

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Shih-Lung Huang, Kaohsiung (TW); Yi-Syuan Jhao, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 14/556,483

(22) Filed: Dec. 1, 2014

(51) Int. Cl.
*A47B 88/00* (2006.01)
*A47B 88/04* (2006.01)
*A47B 88/16* (2006.01)

(52) U.S. Cl.
CPC ..... *A47B 88/047* (2013.01); *A47B 88/16* (2013.01); *A47B 88/0085* (2013.01)

(58) Field of Classification Search
CPC ..... A47B 88/047; A47B 88/0481
USPC ..... 312/333, 319.1
See application file for complete search history.

(56) References Cited

U.S. PATENT DOCUMENTS 6,712,435 B2 3/2004 Kim et al.
6,733,097 B2 5/2004 Kim et al.
6,971,729 B1 12/2005 Kim et al.
7,244,005 B1 * 7/2007 Lu ..... A47B 88/047 312/319.1
7,878,606 B2 2/2011 Chen et al.
8,256,853 B2 * 9/2012 Chen ..... F16C 29/02 312/319.1
8,496,306 B2 * 7/2013 Chen ..... A47B 88/0477 312/319.1
8,801,120 B2 * 8/2014 Chen ..... A47B 88/0471 312/333
8,939,525 B1 * 1/2015 Chen ..... A47B 88/047 312/333
2006/0082266 A1 4/2006 Le et al.
2008/0100190 A1 * 5/2008 Yang ..... A47B 88/047 312/333
2009/0140621 A1 * 6/2009 Yang ..... A47B 88/10 312/319.1
2010/0164340 A1 * 7/2010 Juan ..... A47B 88/047 312/333
2011/0101839 A1 * 5/2011 Boks ..... A47B 88/047 312/333
2011/0175508 A1 * 7/2011 Rechberg ..... A47B 88/047 312/334.8
2011/0215690 A1 * 9/2011 Juan ..... A47B 88/08 312/319.1

(Continued)

FOREIGN PATENT DOCUMENTS

DE 202012007763 * 8/2012
KR 101129570 * 3/2012

(Continued)

*Primary Examiner* — Janet M Wilkens
(74) *Attorney, Agent, or Firm* — Rosenberg, Klein & Lee

(57) ABSTRACT

A self-closing slide rail assembly with a deceleration mechanism includes first and second rails and a self-closing mechanism, in addition to the deceleration mechanism. The self-closing mechanism is mounted to the first rail and includes an elastic member for providing an elastic force in a first direction. The deceleration mechanism includes a deceleration spring for providing an elastic force in an opposite second direction. When the second rail is displaced from an extended position toward a retracted position relative to the first rail, the self-closing mechanism automatically drives the second rail toward the retracted position due to the elastic force applied by the elastic member. Meanwhile, the elastic force of the deceleration spring serves as a deceleration force, allowing the second rail to move slowly to the retracted position.

14 Claims, 18 Drawing Sheets

(56) References Cited

U.S. PATENT DOCUMENTS

| | | | | |
|---|---|---|---|---|
| 2014/0079347 | A1* | 3/2014 | Huang | A47B 88/047 384/21 |
| 2015/0131929 | A1* | 5/2015 | Park | A47B 88/047 384/21 |

FOREIGN PATENT DOCUMENTS

| | | |
|---|---|---|
| WO | 2007/111424 | * 10/2007 |
| WO | 2008/071168 | * 6/2008 |

* cited by examiner

SELF-CLOSING SLIDE RAIL ASSEMBLY WITH DECELERATION MECHANISM

FIELD OF THE INVENTION

The present invention relates to a slide rail. More particularly, the present invention relates to a self-closing slide rail assembly having a deceleration mechanism whereby a second rail being retracted relative to a first rail is automatically and slowly moved to the retracted position.

BACKGROUND OF THE INVENTION

Generally speaking, a drawer or the like can be pulled out of or pushed back into a frame (e.g., a cabinet) by means of slide rails, and the pulling or pushing process is accomplished mostly by the force exerted by the operator. Currently, the market is also supplied with products featuring automatic slide rail retraction, in which the slide rails are automatically retractable so that a drawer pushed toward the retracted position and having entered the last part of its retracting course can be driven to the retracted position automatically.

Designs of such automatically retractable slide rails are disclosed in U.S. Pat. Nos. 6,712,435; 6,733,097; 6,971,729; and 7,878,606, all of which are incorporated herein by reference.

The '435 patent discloses a self-closing slide which, according to FIG. 2A, FIG. 2B, FIG. 3, and FIG. 16 of the patent, includes a self-closing mechanism (46) mounted at an end portion of an outer slide member (16). The self-closing mechanism (46) generally includes a housing (48), a spring (86) located in the housing (48), a guide pin (78) extending through the spring (86), and a slot (90). The slot (90) includes a longitudinal portion (92) and a transverse portion (100) extending transversely with respect to the longitudinal portion (92). The slot (90) is provided therein with an actuator guide member (108) displaceable between the transverse portion (100) and the longitudinal portion (92). In addition, an inner slide member (12) has an end portion formed with a first slot portion (110) and a second slot portion (114). The first slot portion (110) at the end portion of the inner slide member (12) corresponds to the actuator guide member (108) in the housing (48) of the self-closing mechanism (46). When the inner slide member (12) is displaced toward a retracted position, the actuator guide member (108) is guided by the first slot portion (110) and the second slot portion (114) of the inner slide member (12) and, thanks to the elastic force provided by the spring (86) along the guide pin (78), retracts the inner slide member (12) automatically. Thus, the objective of providing a self-closing slide is achieved.

It can be known from the patents cited above that automatically retractable slide rails are diversified in design, which reflects the market demand for such products. It is important, therefore, to make further improvement on the existing automatic retraction function and develop an easy-to-operate self-closing slide rail assembly in which a slide rail automatically retracted toward a retracted position relative to another slide rail is moved to the retracted position not only automatically but also slowly.

SUMMARY OF THE INVENTION

The present invention relates to a self-closing slide rail assembly with a deceleration mechanism by which a second rail being retracted with respect to a first rail is moved to the retracted position both automatically and slowly.

According to one aspect of the present invention, a self-closing slide rail assembly with a deceleration mechanism includes a first rail, a second rail, and a self-closing mechanism, in addition to the deceleration mechanism. The second rail can be longitudinally displaced relative to the first rail and is provided with a stop portion. The self-closing mechanism is mounted to the first rail such that, in the course in which the second rail is retracted in a first direction from an extended position toward a retracted position relative to the first rail, the self-closing mechanism automatically moves the second rail back to the retracted position by means of the stop portion. The self-closing mechanism includes a housing, a movable member, and an elastic member. The movable member is movably connected with the housing and includes an actuating portion. The elastic member serves to apply to the movable member an elastic force in the first direction. The deceleration mechanism includes a base, a supporting member, and a deceleration spring. The supporting member is movably connected with the base and has a portion corresponding to the movable member of the self-closing mechanism. The deceleration spring serves to apply to the supporting member an elastic force in a second direction opposite the first direction, wherein the elastic force applied by the deceleration spring is less than the elastic force applied by the elastic member. While the second rail is being operated and displaced in the first direction from the extended position toward the retracted position, and the actuating portion of the movable member is engaged with the stop portion, the movable member drives the supporting member in response to the elastic force applied by the elastic member. Thus, with the elastic force applied by the deceleration spring counteracting the elastic force applied by the elastic member, the movable member automatically and slowly moves the second rail back to the retracted position.

According to another aspect of the present invention, a self-closing slide rail assembly with a deceleration mechanism includes a first rail, a second rail, and a self-closing mechanism, in addition to the deceleration mechanism. The second rail can be longitudinally displaced between a retracted position and an extended position relative to the first rail and is provided with a stop portion. The self-closing mechanism is mounted to the first rail such that, in the last part of the retracting course of the second rail, in which the second rail is displaced in a first direction from the extended position toward the retracted position, the self-closing mechanism automatically moves the second rail back to the retracted position by means of the stop portion. The self-closing mechanism includes a housing, a movable member, and an elastic member. The housing includes an engaging portion. The movable member is movably connected with the housing and includes an actuating portion for engaging with the stop portion. The elastic member serves to apply to the movable member an elastic force in the first direction. When the actuating portion of the movable member is engaged with the stop portion, and the second rail is so operated as to be displaced in a second direction toward the extended position, the movable member is driven by the second rail into engagement with the engaging portion of the housing such that the elastic member accumulates the elastic force in the first direction. The deceleration mechanism includes a base, a supporting member, and a deceleration spring. The supporting member is movably connected with the base and has a portion corresponding to the movable member of the self-closing mechanism. The deceleration spring serves to apply to the supporting member an elastic force in the second direction, wherein the elastic force applied by the deceleration spring is less than the elastic force applied by the elastic member. When the second rail is being so operated as to be displaced in the first direction from the extended position toward the retracted position, the actuating portion of the movable member of the self-closing mechanism can be engaged with the stop portion, causing the movable member to disengage from the engaging portion and drive the supporting member in response to the elastic force applied by the elastic member. Thus, with the elastic force applied by the deceleration spring counteracting the elastic force of the elastic member, the movable member automatically and slowly moves the second rail back to the retracted position via the actuating portion.

According to yet another aspect of the present invention, a self-closing mechanism capable of deceleration includes a housing, a movable member, an elastic member, and a deceleration mechanism. The movable member is movably connected with the housing. The elastic member serves to apply an elastic force to the movable member in a first direction. When the movable member is engaged with the housing at a predetermined position thereof, the elastic member accumulates the elastic force in the first direction. The deceleration mechanism includes a base, a supporting member, and a deceleration spring. The base is connected with the housing. The supporting member is longitudinally movably connected with the base and has a portion corresponding to the movable member. The deceleration spring serves to apply to the supporting member an elastic force in a second direction opposite the first direction, wherein the elastic force applied by the deceleration spring is less than the elastic force applied by the elastic member.

When the movable member drives the supporting member in response to the elastic force applied by the elastic member, the elastic force applied by the deceleration spring counteracts the elastic force applied by the elastic member such that the movable member is moved relative to the housing at a reduced speed.

One of the advantageous features of implementing the present invention is that the second rail, when retracted with respect to the first rail, is moved to the retracted position automatically and slowly.

BRIEF DESCRIPTION OF THE DRAWINGS

The invention as well as a preferred mode of use and the advantages thereof will be best understood by referring to the following detailed description of some illustrative embodiments in conjunction with the accompanying drawings, in which.

DETAILED DESCRIPTION OF THE INVENTION

Figure 1:
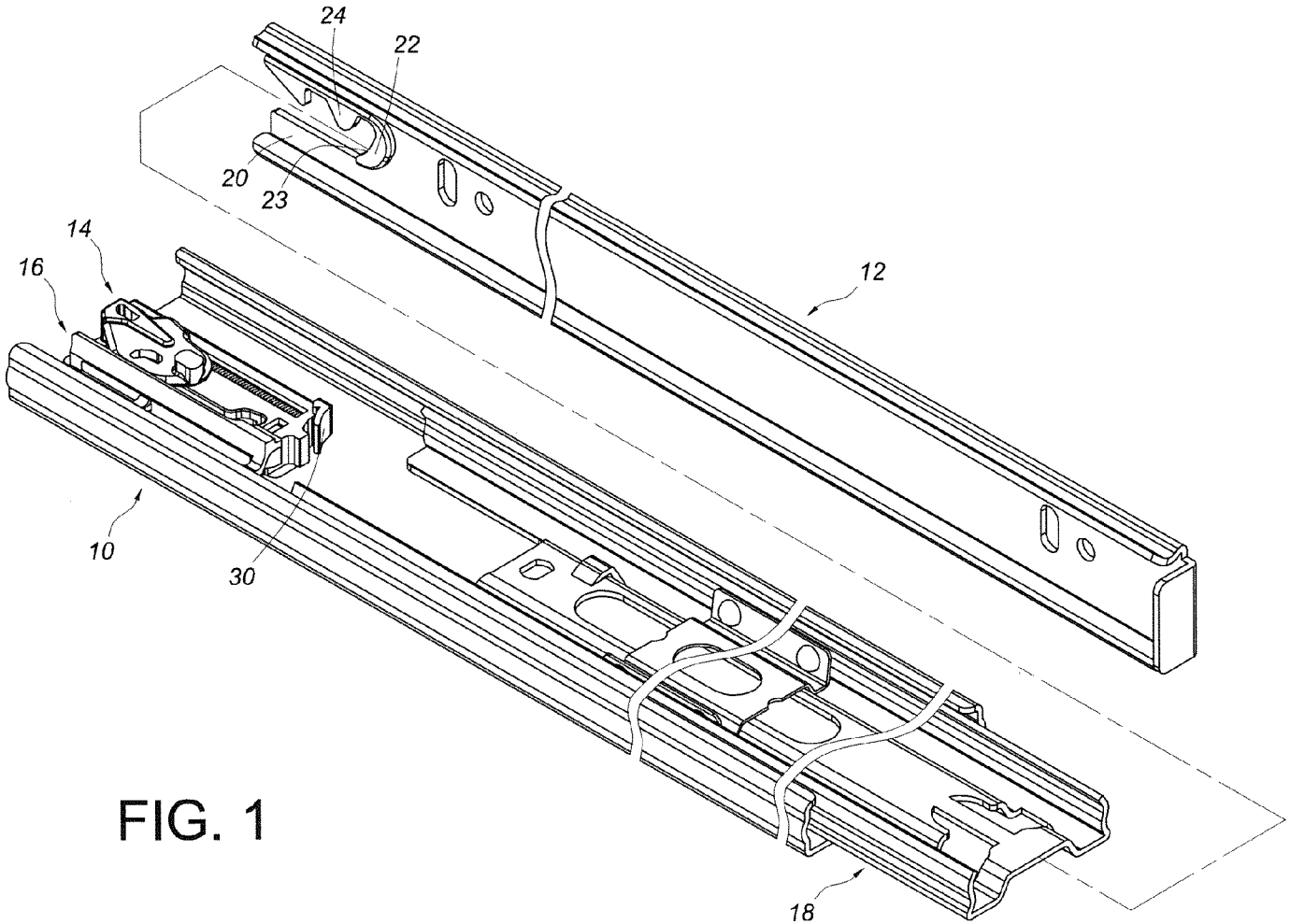
FIG. 1 is a schematic perspective view of the first embodiment of the self-closing slide rail assembly with a deceleration mechanism according to the present invention, in which the second rail is detached from the third rail.
Figure 2:
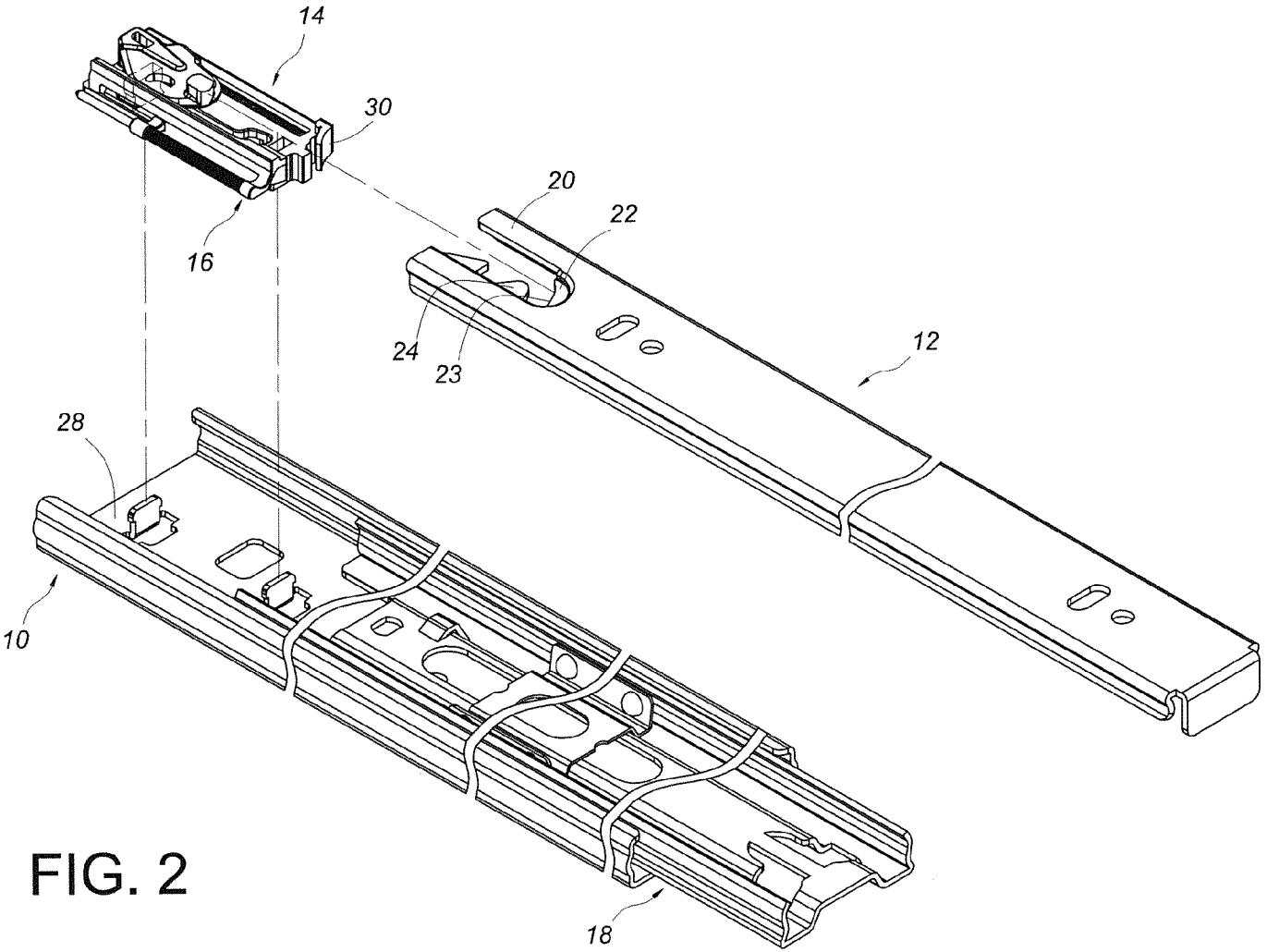
FIG. 2 is a schematic exploded perspective view of the first embodiment of the self-closing slide rail assembly with a deceleration mechanism according to the present invention, in which the self-closing mechanism corresponds to and is to be mounted to the first rail while the second rail corresponds to the self-closing mechanism.

Referring to FIG. 1 and FIG. 2, the self-closing slide rail assembly with a deceleration mechanism (hereinafter referred to as the self-closing slide rail assembly for short) in the first embodiment of the present invention includes a first rail 10, a second rail 12, a self-closing mechanism 14, and a deceleration mechanism 16. Preferably, the self-closing slide rail assembly further includes a third rail 18.

The second rail 12 can be longitudinally displaced relative to the first rail 10. Here, the second rail 12 is longitudinally movably connected to the first rail 10 via the third rail 18. More specifically, the third rail 18 is movably connected between the first rail 10 and the second rail 12. Thanks to the third rail 18, the distance by which the second rail 12 can be pulled out relative to the first rail 10 is increased.

It should be pointed out that while the present embodiment shows a three-section slide rail, the self-closing slide rail assembly of the present invention is not limited to this configuration. In an embodiment which is not shown herein, for example, a two-section slide rail is formed instead.

The second rail 12 includes an end portion 20 corresponding to the self-closing mechanism 14. In this embodiment, the second rail 12 further includes a guide portion 22 and a stop portion 24, both of which are adjacent to the end portion 20 of the second rail 12. The guide portion 22 has a curved guide surface 23. The stop portion 24 can be formed by the second rail 12. In an embodiment which is not shown herein, however, the guide portion 22 and the stop portion 24 are fixed to the second rail 12 at positions adjacent to the end portion 20 by an attaching means, such as projection-recess engagement, threaded connection, or rivet connection.

The self-closing mechanism 14 is mounted to the first rail 10. In practice, the self-closing mechanism 14 can be mounted to the first rail 10 at a position adjacent to its end portion 28 by threaded connection, rivet connection, projection-recess engagement, or the like. The present invention imposes no limitations on the mounting method to be used. Preferably, the self-closing mechanism 14 has an end portion provided with at least one cushioning portion 30 against which the third rail 18 can be pressed when moved toward a retracted position relative to the first rail 10, and which therefore provides cushioning protection for the third rail 18.

Figure 3:
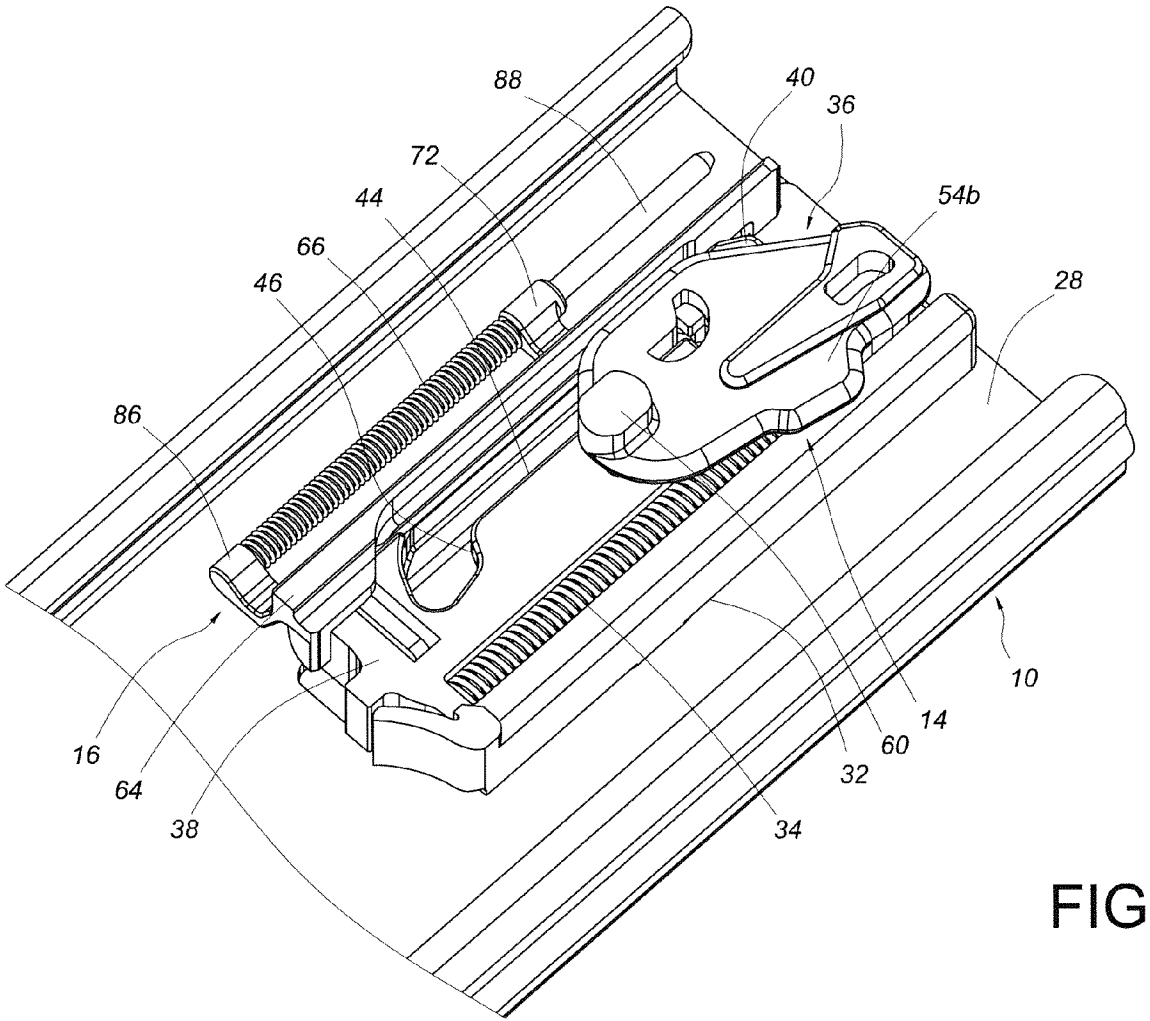
FIG. 3 is a schematic perspective view showing how the self-closing mechanism and the deceleration mechanism in the first embodiment of the present invention are mounted to the first rail.

As shown in FIG. 3, the self-closing mechanism 14 and the deceleration mechanism 16 are assembled together. However, the self-closing mechanism 14 in FIG. 3 is but one illustrative embodiment, to which implementation of the self-closing mechanism is by no means limited. In one preferred embodiment, referring to FIG. 4, the self-closing mechanism 14 includes a housing 32, an elastic member 34, and a movable member 36.

The housing 32 is mounted to the first rail 10 at a position adjacent to the end portion 28. The housing 32 includes a front end portion 38, a rear end portion 40, a longitudinal room 42 extends between the front end portion 38 and the rear end portion 40, a longitudinal portion 44 parallel to the longitudinal room 42, an engaging portion 46 extending transversely from the front end of, and at an angle with respect to, the longitudinal portion 44, and a stop wall 48 adjacent to the rear end portion 40. The longitudinal room 42 has a mounting opening 50 adjacent to the rear end portion 40.

The elastic member 34 is inserted into the longitudinal room 42 through the mounting opening 50.

The movable member 36 is movably connected with the housing 32 and can be longitudinally displaced relative to the first rail 10. The movable member 36 includes a first side 54*a* and a second side 54*b* opposite the first side 54*a*. The first side 54*a* has a first projection 56 and a second projection 58. The second side 54*b* includes an actuating portion 60. The first projection 56 corresponds to and is pressed by the elastic member 34 and is located in the longitudinal room 42 of the housing 32 while the second projection 58 is movably pressed against the longitudinal portion 44. The movable member 36 can respond, through the first projection 56, to the elastic force generated by the elastic member 34 such that the first projection 56 of the movable member 36 is displaced in the longitudinal room 42 of the housing 32 and the second projection 58 is displaced along the longitudinal portion 44 until the second projection 58 of the movable member 36 is pressed against and hence stopped by the stop wall 48 of the housing 32 (see FIG. 3).

Figure 4:
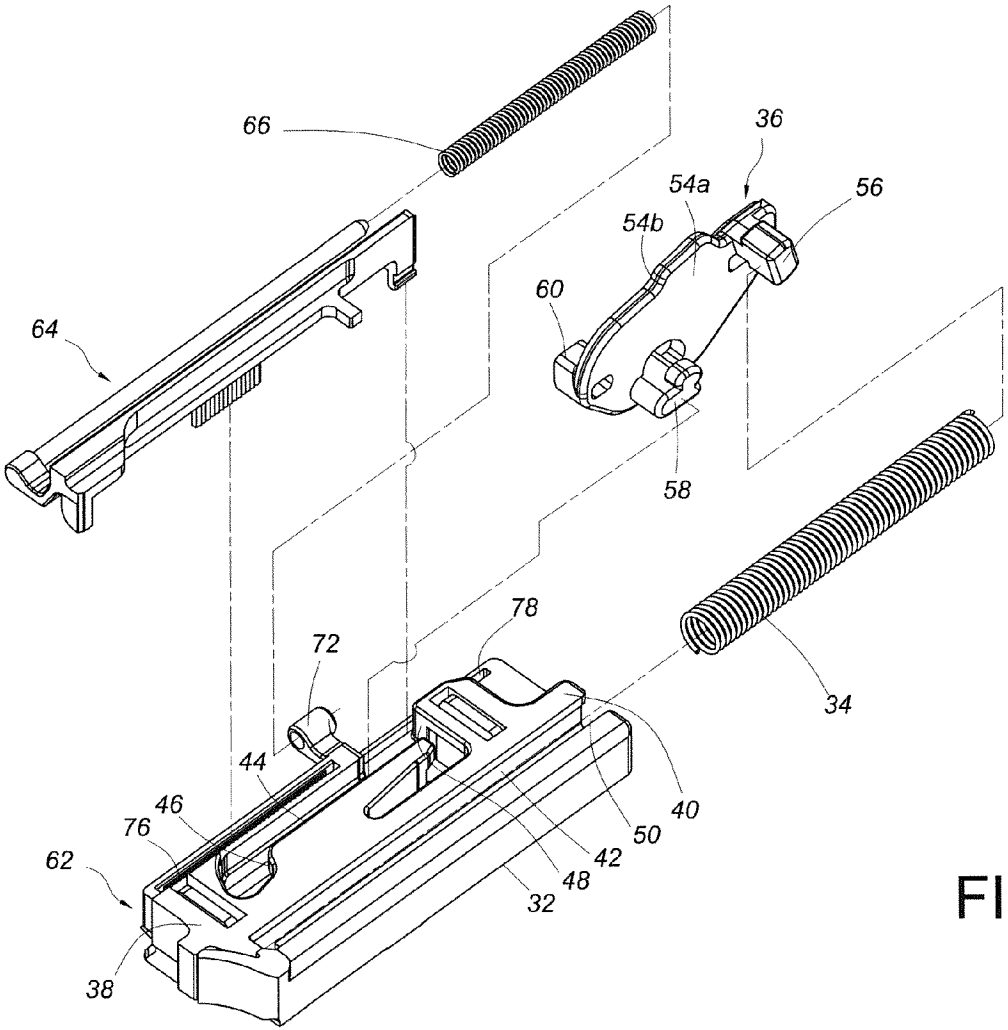
FIG. 4 is a schematic exploded view of the self-closing mechanism and the deceleration mechanism in the first embodiment of the present invention.
Figure 5:
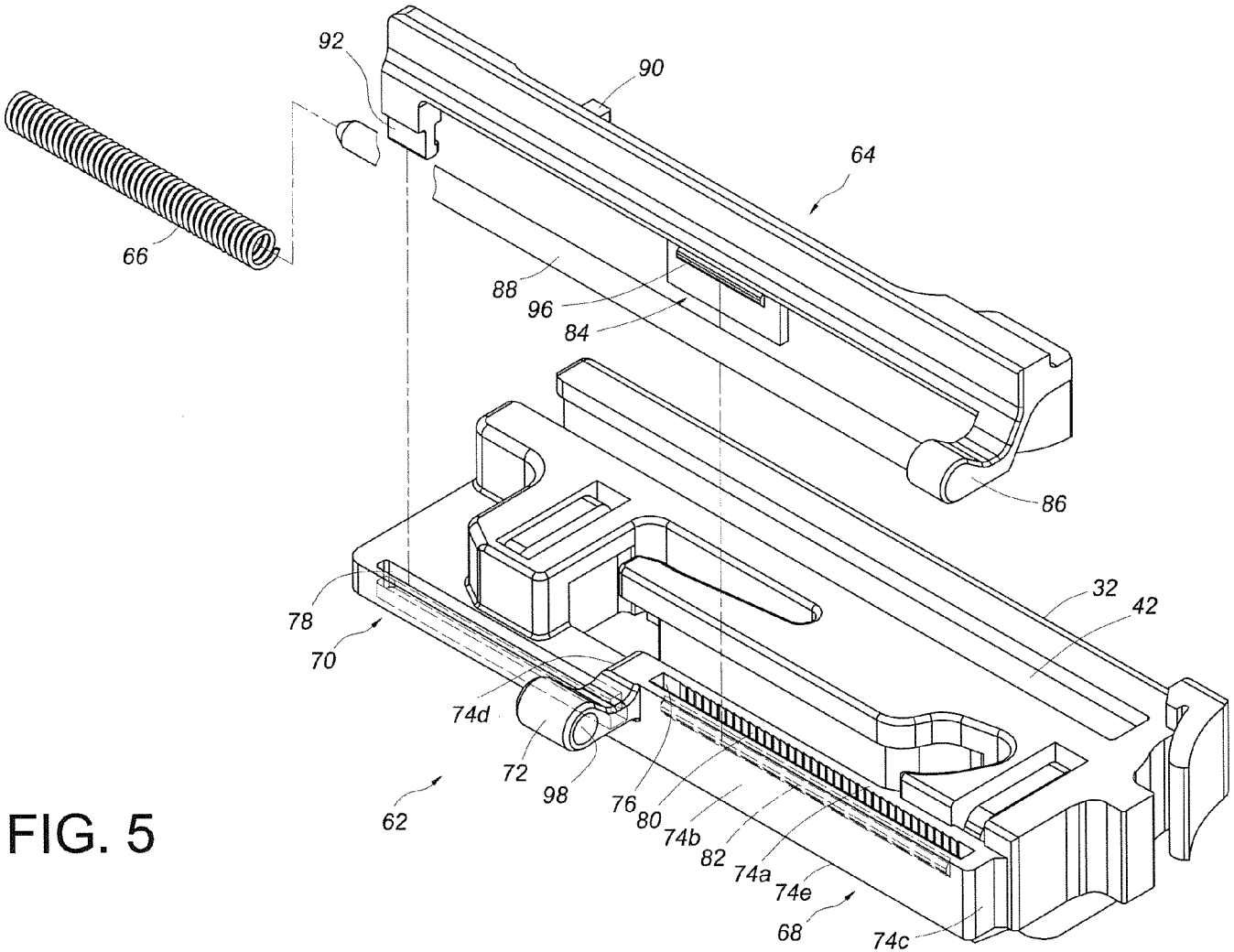
FIG. 5 is a schematic perspective view showing how the supporting member of the deceleration mechanism in the first embodiment of the present invention corresponds to and is mounted to the base, the drawing also showing that the friction portion has a rib and that the damping room has an internal groove corresponding to the rib.

In one preferred embodiment, referring to FIG. 4 and FIG. 5 in conjunction with FIG. 3, the deceleration mechanism 16 includes a base 62, a supporting member 64, and a deceleration spring 66.

The base 62 is connected with the housing 32 of the self-closing mechanism 14. For example, the base 62 is integrally formed with the housing 32 of the self-closing mechanism 14, or, as in an embodiment which is not shown herein, the base 62 and the housing 32 are adjacent separate elements individually mounted to the first rail 10. The base 62 includes a first longitudinal section 68, a second longitudinal section 70 extending from the first longitudinal section 68, and a supporting portion 72. In one preferred embodiment, the first longitudinal section 68 at least includes a first wall 74*a*, a second wall 74*b*, a front wall 74*c*, a rear wall 74*d* and a bottom wall 74*e* extending between the first wall 74*a* and the second wall 74*b*. The first wall 74*a*, the second wall 74*b*, the front wall 74*c*, the rear wall 74*d* and the bottom wall 74*e* jointly define a damping room 76. The damping room 76 is generally parallel to the longitudinal room 42 of the housing 32. The second longitudinal section 70 defines a longitudinal channel 78.

The supporting portion 72 extends transversely from between the first longitudinal section 68 and the second longitudinal section 70 or from one of the first longitudinal section 68 and the second longitudinal section 70. Preferably, the supporting portion 72 is transversely connected to and extends transversely from the first longitudinal section 68.

Figure 6:
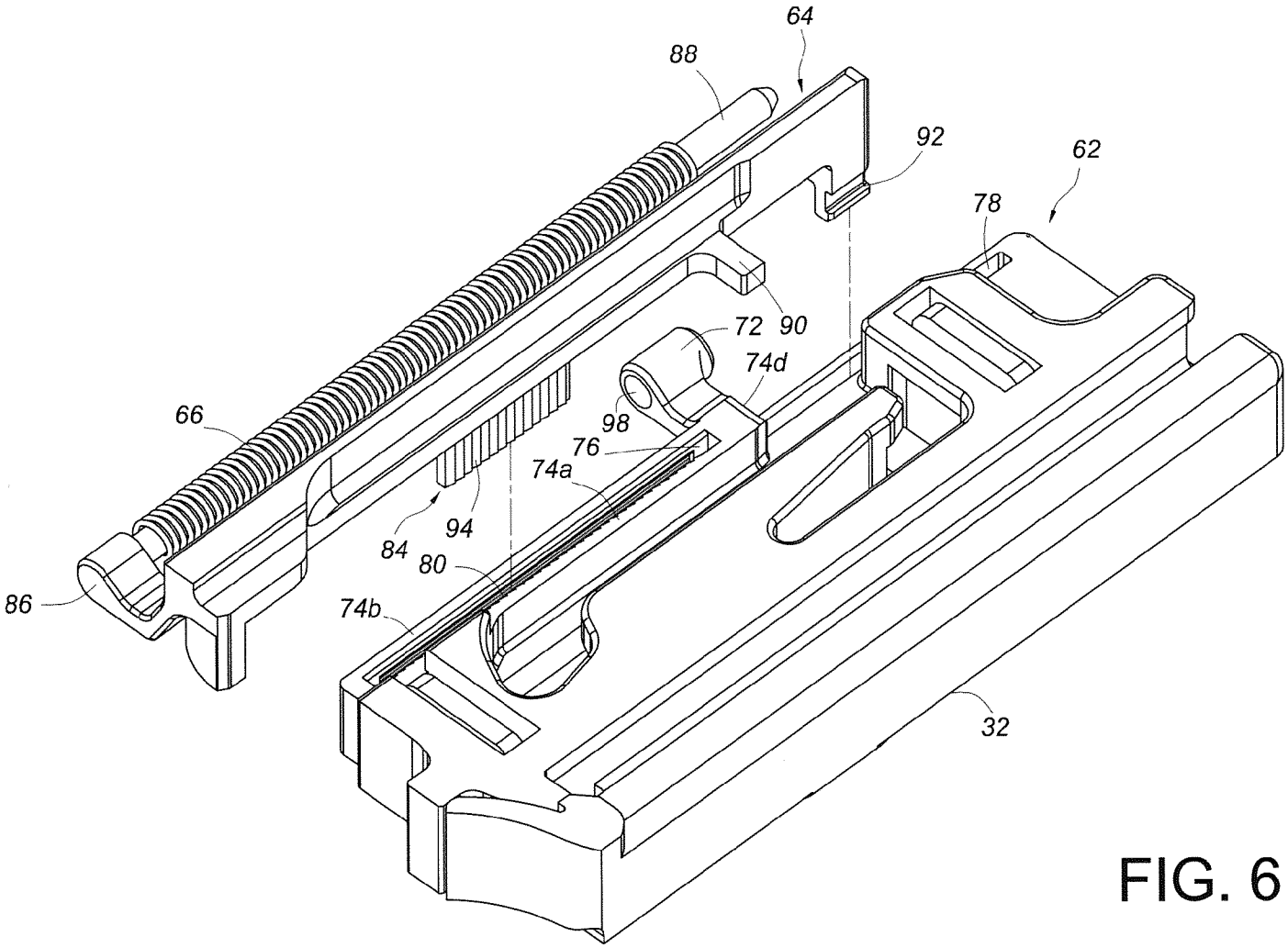
FIG. 6 is a schematic exploded perspective view showing how the supporting member of the deceleration mechanism in the first embodiment of the present invention corresponds to and is mounted to the base, the drawing also showing the friction surface of the friction portion and the friction surface in the damping room.

As shown in FIG. 5 and FIG. 6, the damping room 76 further includes a friction surface 80 on the first wall 74*a* and a groove 82 in the second wall 74*b*. The friction surface 80 is, for example, a serrated surface, a rough surface, or other resistance-providing surface. While the friction surface 80 is depicted herein as a serrated surface, it is understood that the friction surface 80 is not necessarily designed as such.

The supporting member 64 is longitudinally movably connected with the base 62. Here, by way of example, the supporting member 64 is movably connected with the first longitudinal section 68 and the second longitudinal section 70 of the base 62, and the deceleration spring 66 is mounted to the supporting member 64.

In one preferred embodiment, the supporting member 64 includes a friction portion 84, a retainer 86, a connecting portion 88, a contact portion 90, and an auxiliary portion 92. The friction portion 84 is located on one side of the supporting member 64. The retainer 86 is connected to and extends from, for example, a part of the supporting member 64 that is adjacent to an end portion of the supporting member 64. The connecting portion 88 is longitudinally connected to and extends from, for example, the retainer 86. The auxiliary portion 92 is located on one side of the supporting member 64, wherein the auxiliary portion 92 and the friction portion 84 are on the same side of the supporting member 64. Beside, a portion of the auxiliary portion 92 corresponds to the rear wall 74*d* of the first longitudinal section 68.

The supporting member 64 is movably mounted to the damping room 76 via the friction portion 84. Here, the friction portion 84 has a friction surface 94 on one side and a rib 96 on the other side. The friction surface 94 is, for example, a serrated surface, a rough surface, or other resistance-providing surface. While the friction surface 94 of the friction portion 84 is depicted herein as a serrated surface corresponding to the friction surface 80 (e.g., a serrated surface) in the damping room 76, the configuration of the friction surface 94 is not limited to the above. The rib 96 corresponds to the groove 82 in the damping room 76. The corresponding relationship between the rib 96 and the groove 82 makes it possible for the friction portion 84 to move stably in the damping room 76. In an embodiment which is not shown herein, however, the friction portion 84 has a groove while the damping room 76 includes a corresponding rib on the second wall 74*b*. This alternative design also enables stable movement of the friction portion 84 in the damping room 76.

The connecting portion 88 is connected between the supporting portion 72 and the retainer 86. One of the supporting portion 72 and the retainer 86 has an aperture 98 through which the connecting portion 88 extends. The deceleration spring 66 is mounted to the connecting portion 88 and pressed between the supporting portion 72 and the retainer 86. It should be pointed out that while the connecting portion 88 is depicted herein as integrally joined with the retainer 86 and the supporting portion 72 is depicted herein as having the aperture 98 through which the connecting portion 88 extends, it is also feasible that the connecting portion 88 is integrally joined with the supporting portion 72 and that the retainer 86 has the aperture 98 through which the connecting portion 88 extends, as in an embodiment which is not shown herein.

Figure 9A:
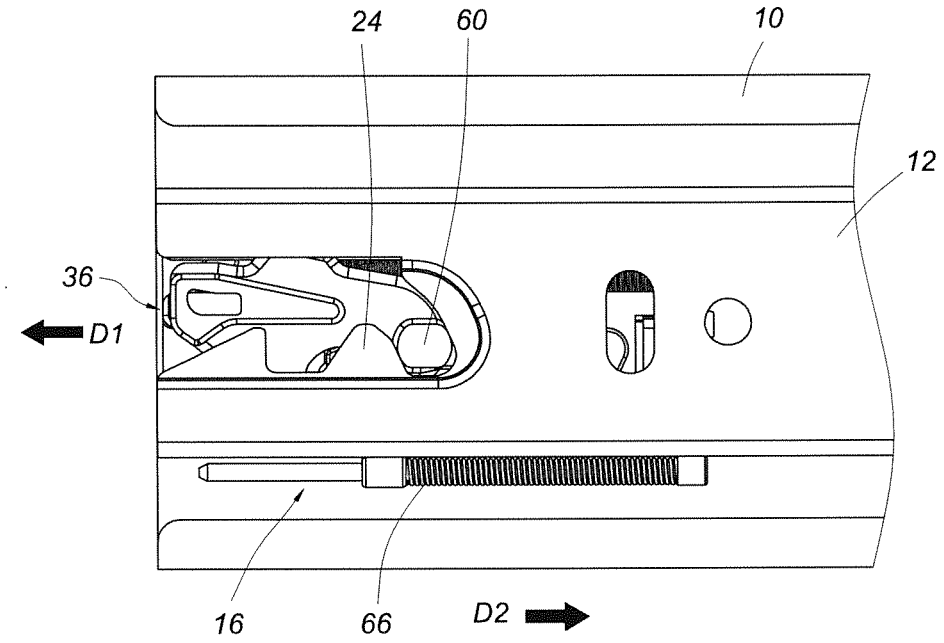
FIG. 9A is a schematic drawing in which the second rail in the first embodiment of the present invention is in a retracted position relative to the first rail while the movable member of the self-closing mechanism is engaged with the stop portion.
Figure 9B:
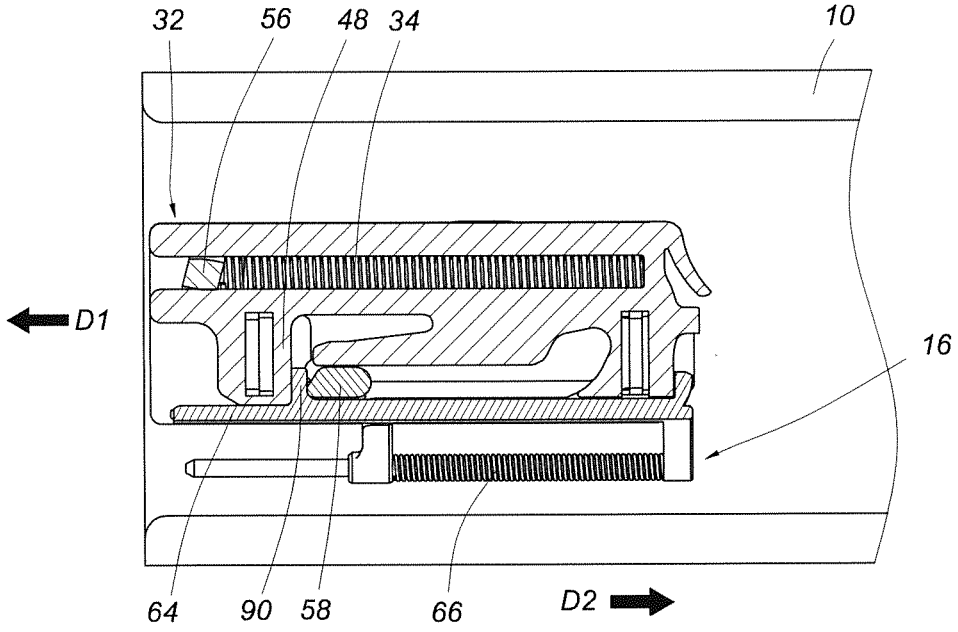
FIG. 9B is another schematic drawing of the state depicted in FIG. 9A, showing that the elastic member applies to the movable member an elastic force in the first direction such that the second projection of the movable member is pressed against a stop wall in an indirect manner (i.e., through the contact portion of the supporting member), the drawing also showing that the deceleration spring applies to the supporting member an elastic force in the second direction.

The contact portion 90 corresponds to the second projection 58 of the movable member 36 such that the second projection 58 can be pressed against the contact portion 90 (as shown in FIG. 9B) or vice versa.

Figure 7:
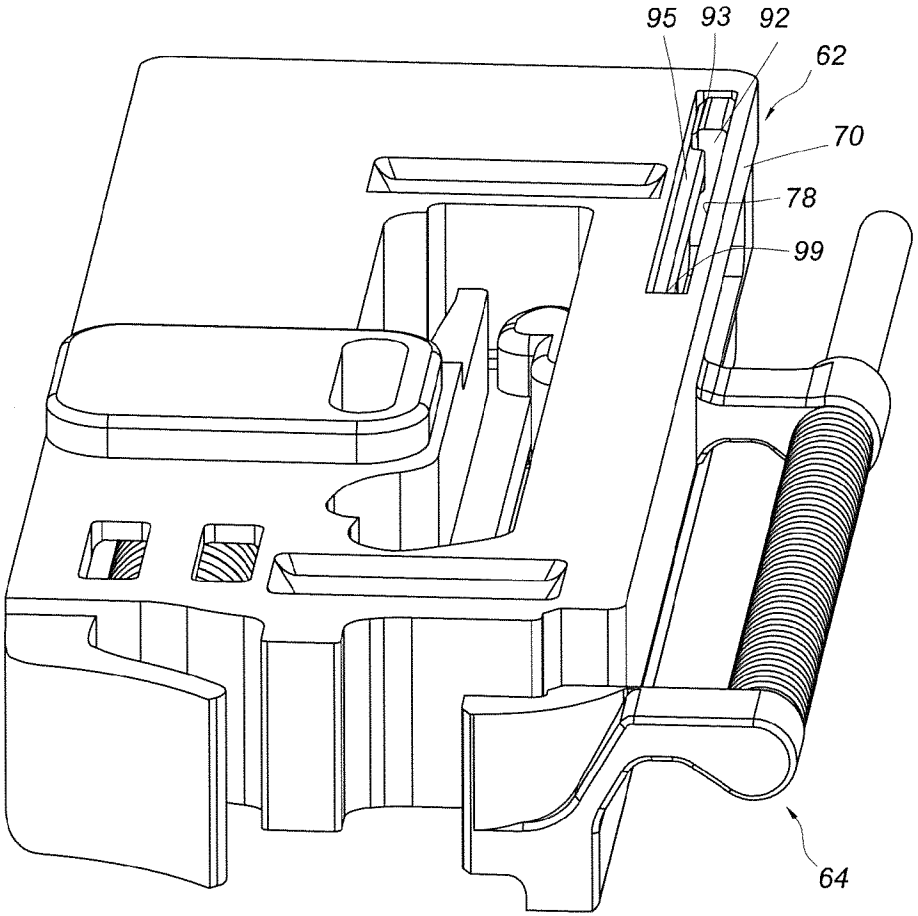
FIG. 7 shows that the supporting member in the first embodiment of the present invention has an auxiliary portion located in a longitudinal channel, and that the auxiliary portion has a hook section for hooking to a wall surface of the base.

Reference is now made to FIG. 7, which provides a bottom view of the base 62. The auxiliary portion 92 corresponds to and can be displaced in the longitudinal channel 78. The second longitudinal section 70 of the base 62 further includes a wall surface 95 adjacent to the longitudinal channel 78 and an end wall 99. In one preferred embodiment, the auxiliary portion 92 further has a hook section 93 to be hooked to the wall surface 95 of the base 62 when the auxiliary portion 92 is in the longitudinal channel 78, in order to increase the stability with which the supporting member 64 can be displaced on the base 62.

Figure 8B:
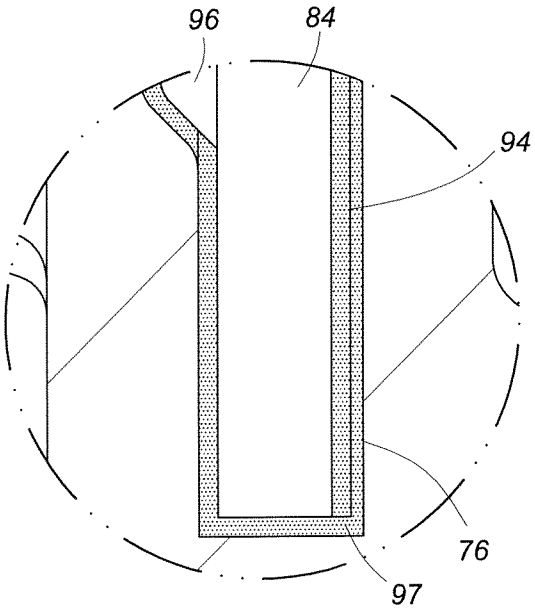
FIG. 8B is a schematic partial enlarged view of FIG. 8A, showing the damping room filled with a cushioning medium.
Figure 8A:
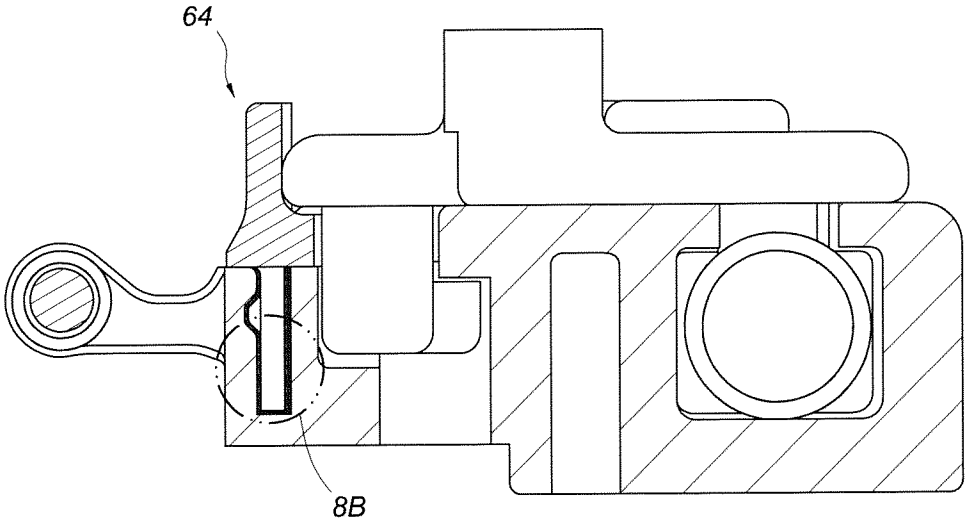
FIG. 8A shows that the friction portion of the supporting member in the first embodiment of the present invention is mounted in the damping room.

As shown in FIG. 8A and FIG. 8B, the friction portion 84 of the supporting member 64 is mounted in the damping room 76, and the damping room 76 is filled with a cushioning medium 97 (e.g., a viscous oil) to provide enhanced cushioning and deceleration when the friction portion 84 of the supporting member 64 is displaced in the damping room 76. For example, the cushioning medium 97 in the damping room 76 covers the entire friction portion 84 of the supporting member 64 (including the friction surface 94 and the rib 96).

FIG. 9A shows the second rail 12 in a retracted position relative to the first rail 10, and FIG. 9B shows how in this state the second projection 58 of the movable member 36 is pressed against the contact portion 90 of the supporting member 64 of the deceleration mechanism 16.

More specifically, when the second rail 12 is in the retracted position relative to the first rail 10, and at least a portion (e.g., the actuating portion 60) of the movable member 36 is in engagement with the stop portion 24, the elastic member 34 provides an elastic force which acts on the first projection 56 of the movable member 36 in a first direction D1. And due to the elastic force applied by the elastic member 34 in the first direction D1, the second projection 58 of the movable member 36 presses the contact portion 90 against the stop wall 48. Meanwhile, the deceleration spring 66 of the deceleration mechanism 16 applies to the supporting member 64 an elastic force in a second direction D2, wherein the elastic force in the second direction D2 acts in a different direction from the elastic force in the first direction D1 (e.g., the second direction D2 being opposite the first direction D1). It should be noted that the elastic force applied by the elastic member 34 in the first direction D1 is greater than the elastic force applied by the deceleration spring 66 in the second direction D2. This ensures that the second rail 12 will stay in the retracted position once fully retracted relative to the first rail 10.

Figure 10A:
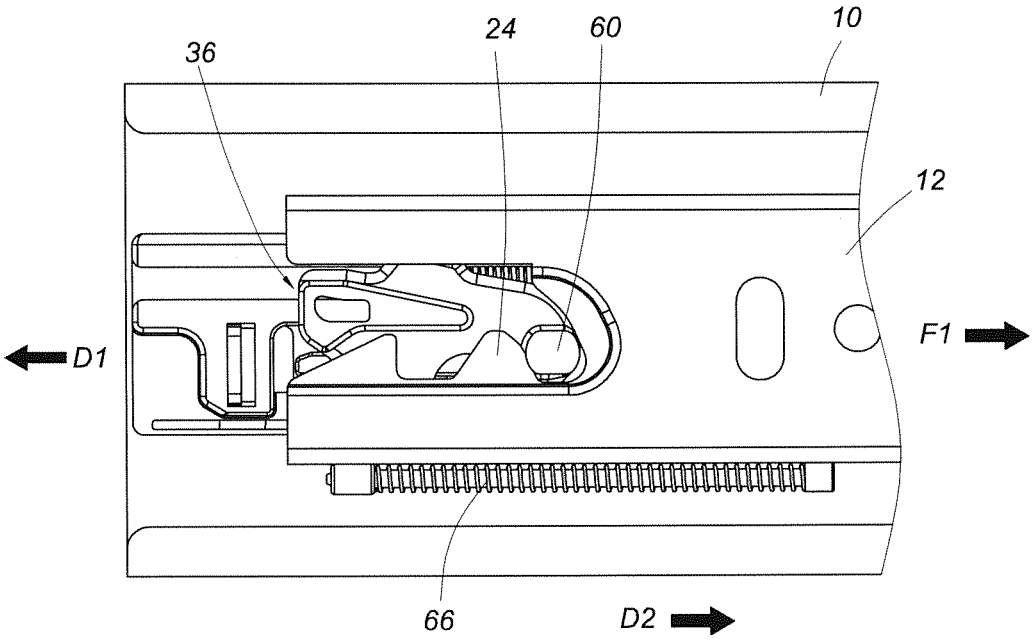
FIG. 10A is a schematic drawing in which the second rail in the first embodiment of the present invention is displaced from the retracted position toward the extended position relative to the first rail.
Figure 10B:
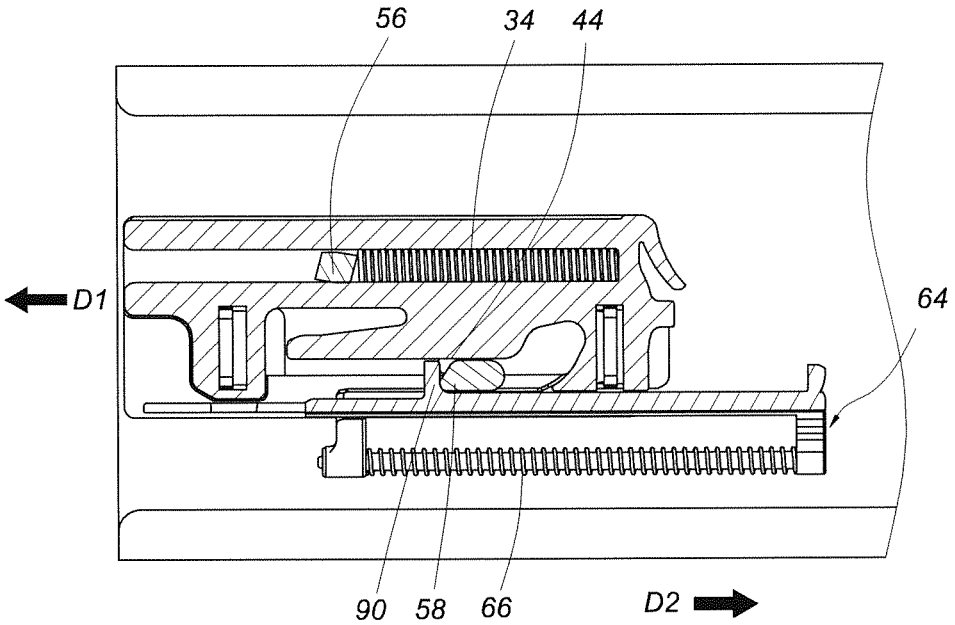
FIG. 10B is another schematic drawing of the state depicted in FIG. 10A, showing that the elastic member accumulates an elastic force in the first direction, and that the deceleration spring applies to the supporting member an elastic force in the second direction such that the supporting member is displaced and pressed against the second projection of the movable member.

FIG. 10A and FIG. 10B show the second rail 12 being displaced in the second direction D2 from the retracted position toward an extended position relative to the first rail 10.

More specifically, when the actuating portion 60 of the movable member 36 is engaged with the stop portion 24, and the second rail 12 is subjected to an external force F1 (e.g., the force exerted by an operator) overcoming the elastic force in the first direction D1 and is therefore moved in the second direction D2 toward the extended position relative to the first rail 10, the first projection 56 of the movable member 36 presses the elastic member 34, which, in response to the pressing of the first projection 56, accumulates an elastic force in the first direction D1. In the meantime, the second projection 58 is displaced along the longitudinal portion 44, and in response to the displacement of the second projection 58, the deceleration spring 66 releases some elastic force in the second direction D2. As a result, the supporting member 64 is displaced in the second direction D2, and the contact portion 90 of the supporting member 64 is pressed against the second projection 58 of the movable member 36.

Figure 11A:
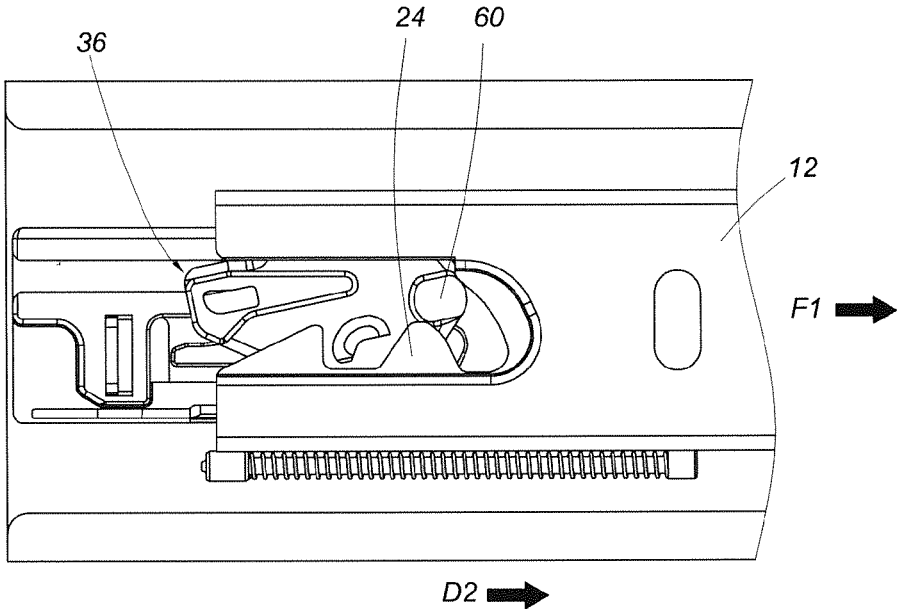
FIG. 11A is a schematic drawing in which the second rail in the first embodiment of the present invention is displaced from the retracted position toward the extended position relative to the first rail, and in which the actuating portion of the movable member is disengaged from the stop portion.
Figure 11B:
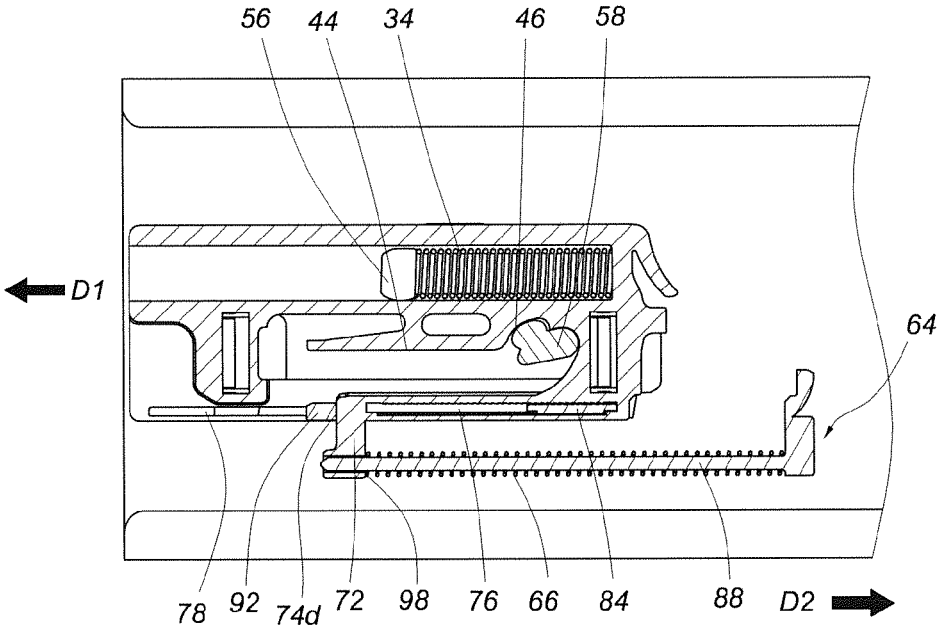
FIG. 11B is another schematic drawing of the state depicted in FIG. 11A, showing that the second projection of the movable member is engaged with the engaging portion, that the elastic member accumulates more elastic force in the first direction, and that the supporting member is displaced to a certain position in response to the elastic force applied by the deceleration spring in the second direction.

Referring to FIG. 11A and FIG. 11B, as the external force F1 continues displacing the second rail 12 longitudinally in the second direction D2 toward the extended position, the second projection 58 of the movable member 36 is displaced along the longitudinal portion 44 and, after turning by an angle, engages with the engaging portion 46 (i.e., being retained at a predetermined position). On the other hand, the actuating portion 60 of the movable member 36 is disengaged from the stop portion 24.

More specifically, while the movable member 36 is engaged with the engaging portion 46, the elastic member 34 accumulates more elastic force in the first direction D1. As the elastic force acts on the first projection 56 of the movable member 36, the second projection 58 of the movable member 36 is kept in engagement with the engaging portion 46. Meanwhile, the supporting member 64 is displaced in response to the elastic force that the deceleration spring 66 continues releasing in the second direction D2. The supporting member 64 will stop displacing in the second direction D2 once the auxiliary portion 92 of the supporting member 64 is pressed against the rear wall 74*d* of the first longitudinal section 68 and/or the end wall 99 of the longitudinal channel 78.

Figure 12A:
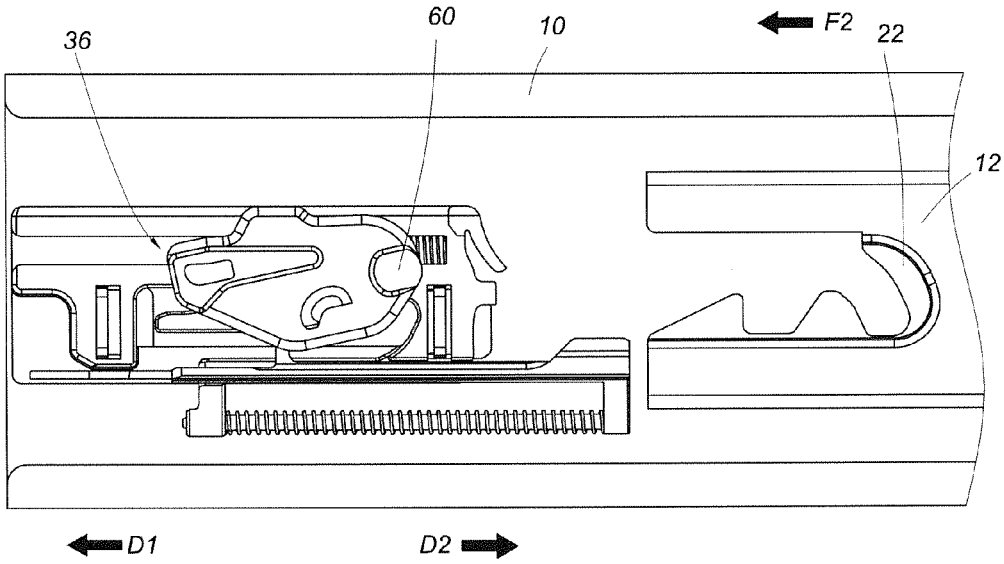
FIG. 12A is a schematic drawing in which the second rail in the first embodiment of the present invention is displaced from the extended position toward the retracted position relative to the first rail, and in which the movable member has yet to engage with the stop portion.
Figure 12B:
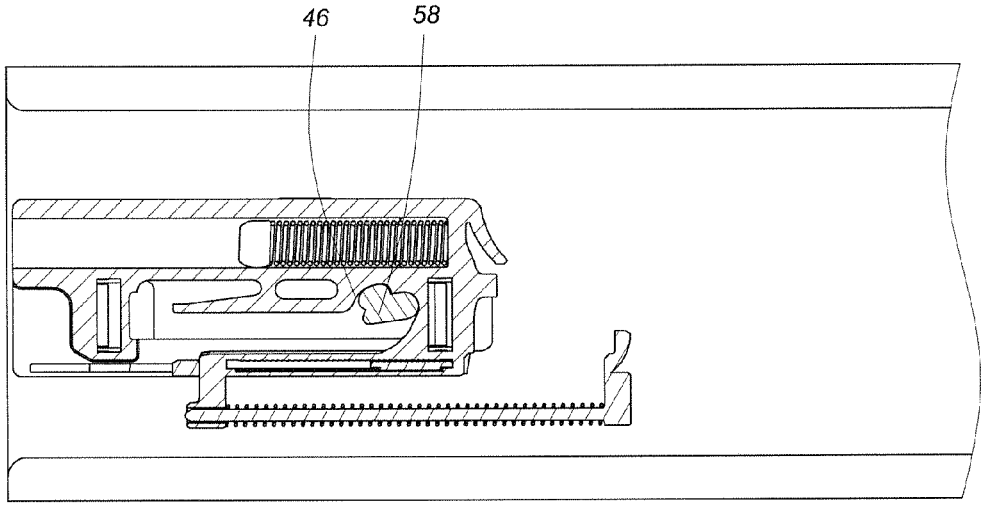
FIG. 12B is another schematic drawing of the state depicted in FIG. 12A, showing that the elastic member accumulates an elastic force in the first direction while the second projection of the movable member is engaged with the engaging portion.

FIG. 12A and FIG. 12B show how the second rail 12 is displaced from the extended position toward the retracted position relative to the first rail 10.

In the course in which the second rail 12 is moved from the extended position toward the retracted position relative to the first rail 10 by an external force F2 (e.g., the force applied by an operator), the guide portion 22 of the second rail 12 corresponds to at least one portion (e.g., the actuating portion 60) of the movable member 36, and the second projection 58 of the movable member 36 is located at the engaging portion 46.

Figure 13A:
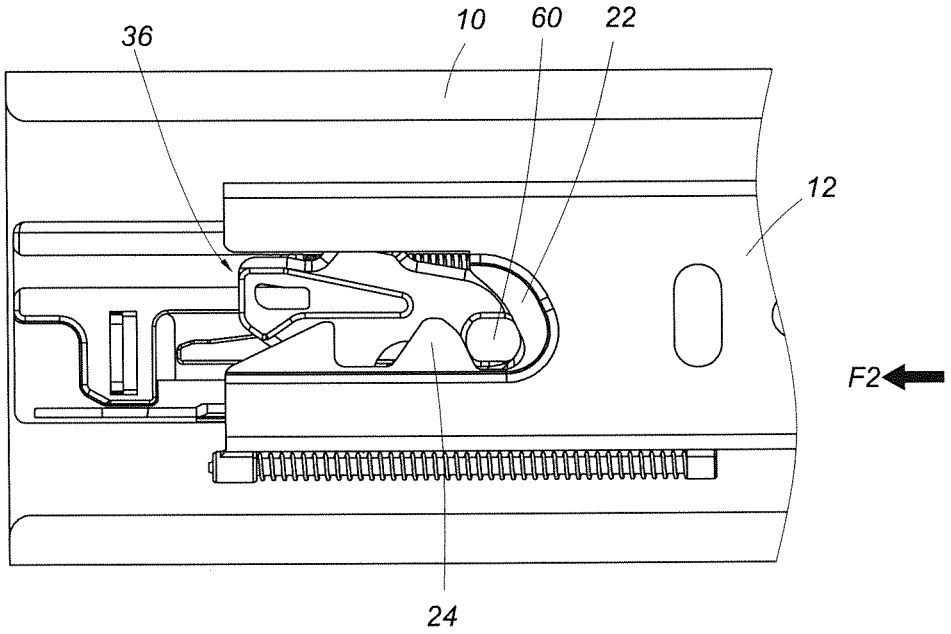
FIG. 13A is a schematic drawing in which the second rail in the first embodiment of the present invention is displaced from the extended position toward the retracted position relative to the first rail, and in which the movable member is engaged with the stop portion.
Figure 13B:
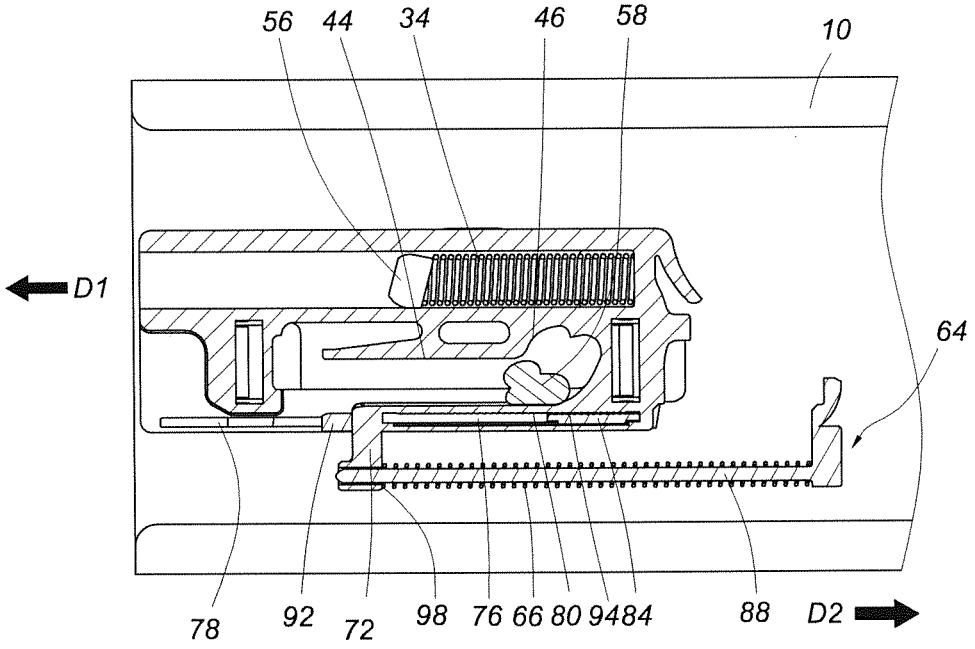
FIG. 13B is another schematic drawing of the state depicted in FIG. 13A, showing that the second projection of the movable member is disengaged from the engaging portion, and that the elastic force released by the elastic member in the first direction is counteracted by the elastic force provided by the deceleration spring in the second direction.

Referring to FIG. 13A and FIG. 13B, as the external force F2 continues moving the second rail 12 from the extended position toward the retracted position relative to the first rail 10 (e.g., when the second rail 12 is in the last part of its retracting course), the actuating portion 60 of the movable member 36 is guided by the guide portion 22 of the second rail 12 and eventually engages with the stop portion 24 such that the second projection 58 of the movable member 36 is no longer engaged with the engaging portion 46. Now that the first projection 56 of the movable member 36 is subjected to the elastic force released by the elastic member 34 in the first direction D1, the movable member 36 is automatically displaced toward the retracted position in response to the elastic force of the elastic member 34. The second rail 12, therefore, is driven by the actuating portion 60 of the movable member 36 and moved automatically toward the retracted position (see FIG. 9A and FIG. 9B).

In the process, the second projection 58 of the movable member 36 pushes at least one portion (e.g., the contact portion 90) of the supporting member 64 and thereby displaces the supporting member 64 in the first direction D1 along with the movable member 36. It should be pointed out that the elastic force provided by the elastic member 34 in the first direction D1 must be able to overcome the elastic force provided by the deceleration spring 66 and acting on the supporting member 64 in the second direction D2 (i.e., the elastic force provided by the deceleration spring 66 can be viewed as resistance against the elastic member 34 and serves to counteract the elastic force of the elastic member 34) in order for the movable member 36 to be displaced along the longitudinal portion 44 in the first direction D1 at a reduced speed and thus automatically and slowly moves the second rail 12 back to the retracted position after the second projection 58 of the movable member 36 leaves the engaging portion 46.

In the process, the friction portion 84 of the supporting member 64 provides further resistance as it is displaced relative to the damping room 76 in the first direction D1, thanks to the friction surface 80 in the damping room 76 or the friction surface 94 of the friction portion 84. This additional resistance lowers the speed at which the second projection 58 of the movable member 36 is displaced from the engaging portion 46 to the longitudinal portion 44, allowing the movable member 36 to move the second rail 12 back to the retracted position slowly as well as automatically.

Moreover, the cushioning medium 97 (see FIG. 8B) in the damping room 76 can effectively decelerate displacement of the friction portion 84 relative to the damping room 76 in the first direction D1 and reduce the sound generated by direct impact between an end portion of the friction portion 84 of the supporting member 64 and the inner wall of the damping room 76. In other words, the cushioning medium 97 is effective in both deceleration and noise reduction.

It can be known from the above that the deceleration force provided by the deceleration mechanism (e.g., the resistance provided by the deceleration spring 66 and the additional resistance provided by the friction surface 80 or the friction surface 94) is less than the elastic force provided by the elastic member 34 of the self-closing mechanism, in order for the movable member 36 to move the second rail 12 back to the retracted position both automatically and slowly, allowing the second rail 12 to decelerate when it has been pushed relative to the first rail 10 to a position adjacent to the last part of its retracting course.

Figure 14:
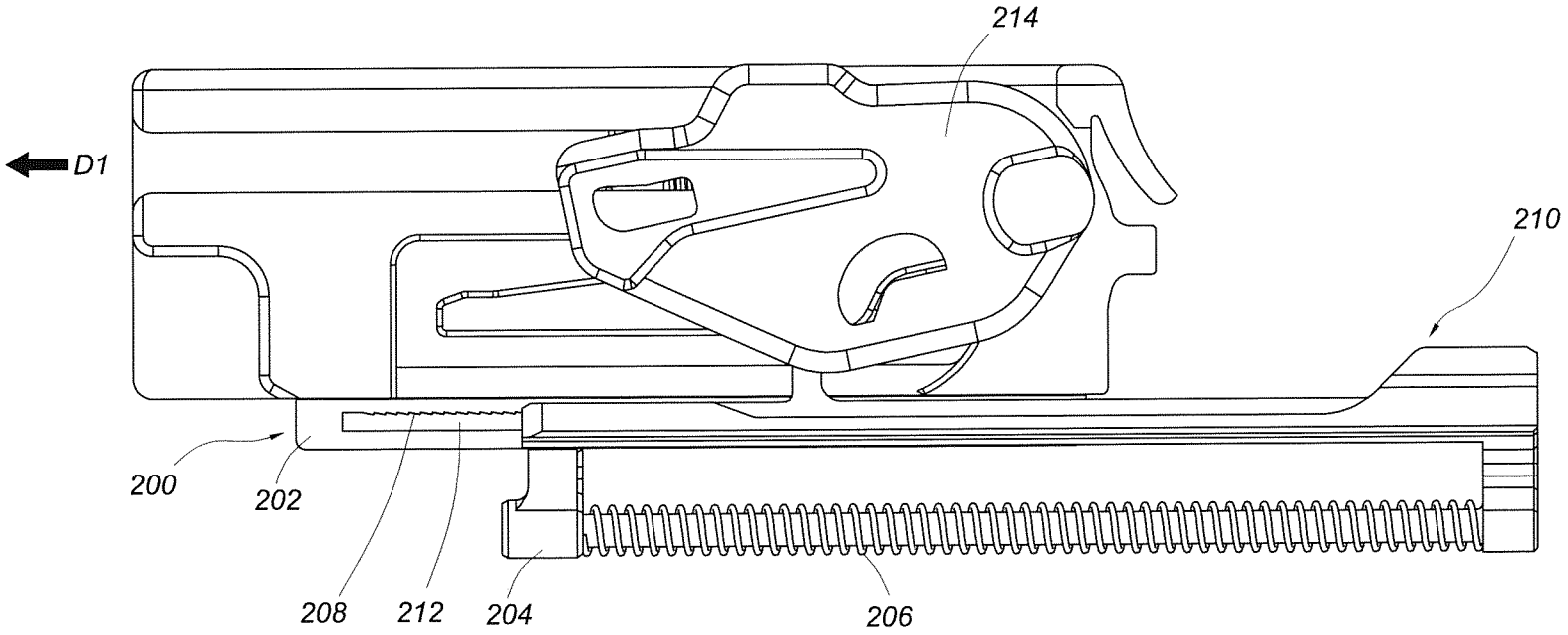
FIG. 14 is a schematic view of the second embodiment of the self-closing slide rail assembly with a deceleration mechanism according to the present invention.

FIG. 14 shows the second embodiment of the self-closing slide rail assembly with a deceleration mechanism according to the present invention.

The second embodiment is different from the first embodiment generally in that the base 200 includes a first longitudinal section 202 and a supporting portion 204 extending transversely from the first longitudinal section 202 (i.e., the base 200 lacks the second longitudinal section 70 in the first embodiment). However, due to the deceleration spring 206, the friction surface 208 of the first longitudinal section 202, the friction surface (not shown) of the supporting member 210, and the cushioning medium in the damping room 212, the movable member 214 is equally capable of automatically and slowly driving the second rail in the first direction D1 to the retracted position. The deceleration spring 206, the friction surfaces, and the cushioning medium in this embodiment are the same as their counterparts in the first embodiment and, for the sake of simplicity, will not be described repeatedly herein.

Figure 15:
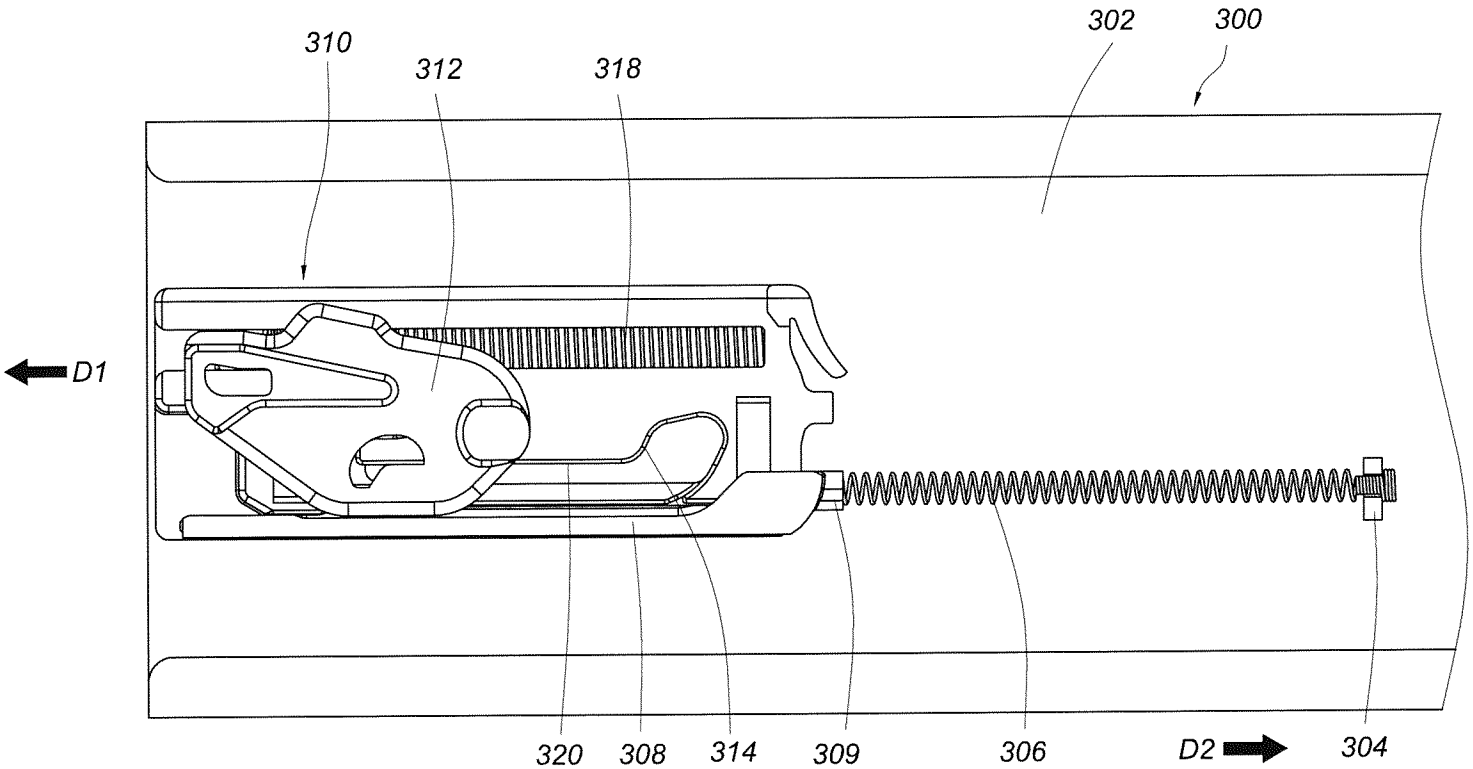
FIG. 15 is a schematic view of the third embodiment of the self-closing slide rail assembly with a deceleration mechanism according to the present invention, in which the deceleration spring is mounted between the connecting section of the first rail and the supporting member.

FIG. 15 shows the third embodiment of the self-closing slide rail assembly with a deceleration mechanism according to the present invention.

The third embodiment is different from the first embodiment generally in that: the first rail 300 further includes a sidewall 302, the sidewall 302 has a connecting section 304, and the deceleration spring 306 is longitudinally connected between the connecting section 304 and a portion (e.g., a front portion 309) of the supporting member 308.

Figure 16:
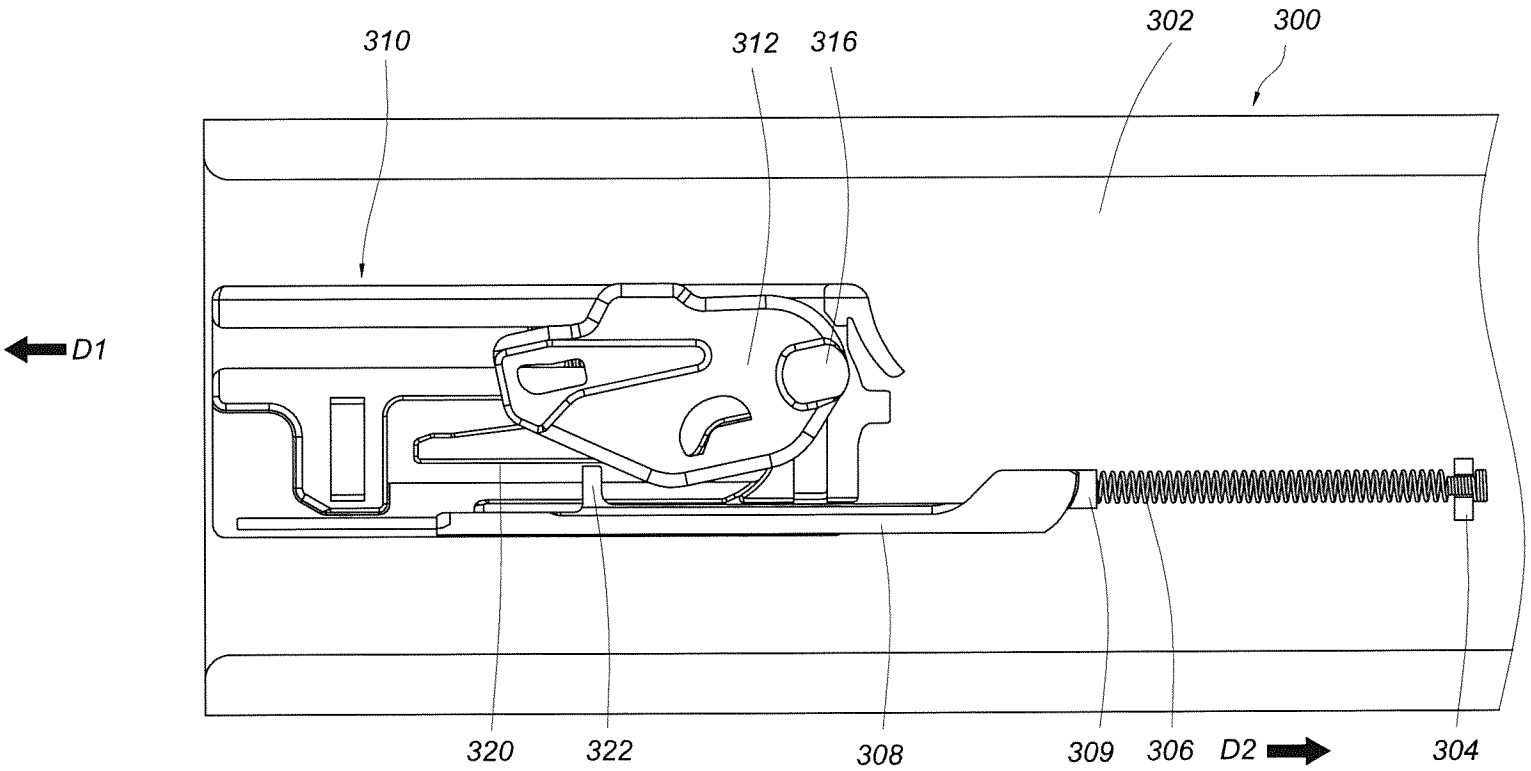
FIG. 16 is a schematic drawing in which the deceleration spring in the third embodiment of the present invention provides an elastic force in a direction opposite the direction of the elastic force accumulated in the elastic member.

Referring to FIG. 15 and FIG. 16, when the second rail (not shown) is in a retracted position relative to the first rail 300, the deceleration spring 306 is stretched and thus accumulates an elastic force in the second direction D2. In the course in which the second rail is moved from the retracted position in the second direction D2 toward an extended position relative to the first rail 300 by an external force, the movable member 312 of the self-closing mechanism 310 is displaced in the second direction D2 along with the second rail and, after turning by an angle, engages with the engaging portion 314. Meanwhile, the deceleration spring 306 releases the elastic force in the second direction D2, and the supporting member 308 is therefore retained at a certain position (see FIG. 16) in response to the elastic force released by the deceleration spring 306. If, in this state, the second rail is retracted in the first direction D1 toward the retracted position relative to the first rail 300, the actuating portion 316 of the movable portion 312 will engage with the second rail (e.g., by means of the stop portion 24 in a way similar to that shown in FIG. 13A), causing the movable member 312 to disengage from the engaging portion 314, and the elastic member 318 to release an elastic force in the first direction D1. Then, in response to the elastic force released by the elastic member 318, the movable member 312, which has left the engaging portion 314, will be displaced along the longitudinal portion 320 in the first direction D1 and thus automatically and slowly move the second rail back to the retracted position.

During the process, the deceleration spring 306 applies to the supporting member 308 an elastic force in the second direction D2, and when the movable member 312 is pressed against the contact portion 322 of the supporting member 308 by the elastic force applied by the elastic member 318 in the first direction D1, the elastic force applied by the deceleration spring 306 serves as resistance against the elastic force applied by the elastic member 318. The movable member 312, therefore, is equally capable of moving the second rail back to the retracted position automatically and slowly.

In addition, the friction surface in the damping room, the friction surface of the friction portion, and the cushioning medium filled in the damping room provide further deceleration when the second rail has been pushed relative to the first rail 300 into the last part of its retracting course. This additional deceleration effect has been disclosed in the first embodiment (with reference to FIG. 13B, FIG. 8A and FIG. 8B) and, for the sake of simplicity, will not be explained repeatedly herein.

Figure 17:
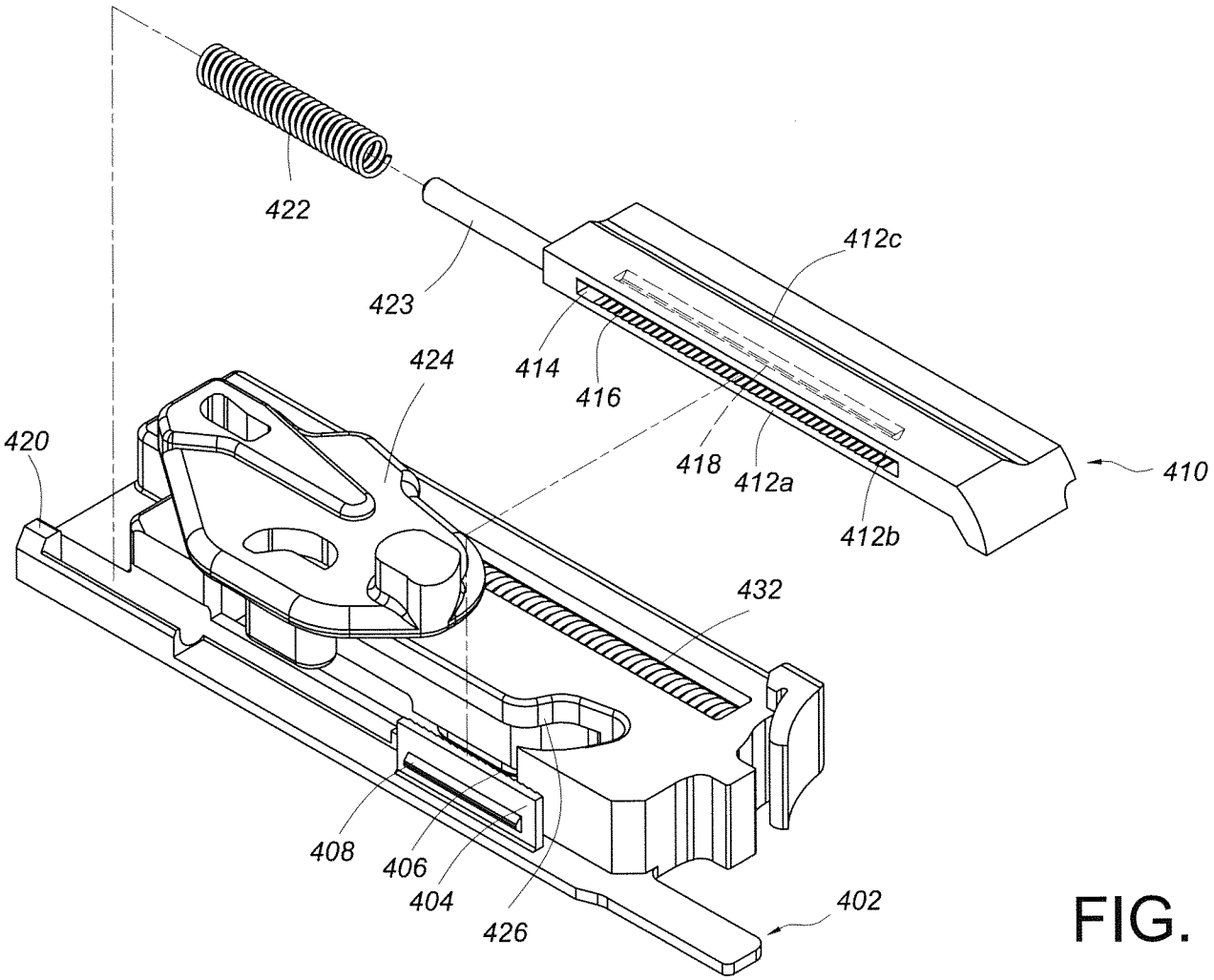
FIG. 17 is a schematic drawing corresponding to the fourth embodiment of the present invention, showing that the base of the deceleration mechanism has a friction portion while the supporting member has a damping room corresponding to the friction portion, the drawing also showing how the deceleration spring is mounted between the supporting member and the base.

FIG. 17 shows the fourth embodiment of the present invention.

The fourth embodiment is different from the first embodiment generally in that: the base 402 of the deceleration mechanism has a friction portion 404; the friction portion 404 has a friction surface 406 and a rib 408 opposite the friction surface 406; the supporting member 410 is movably connected with the friction portion 404; the supporting member 410 at least includes a first wall 412*a*, a second wall 412*b*, and a bottom wall 412*c* extending between the first wall 412*a* and the second wall 412*b*; and the first wall 412*a*, the second wall 412*b*, and the bottom wall 412*c* define a damping room 414 corresponding to the friction portion 404.

The first wall 412*a* of the supporting member 410 includes a friction surface 416 located in the damping room 414 and corresponding to the friction surface 406 of the friction portion 404 (e.g., the friction surfaces 416 and 406 being corresponding serrated surfaces). The second wall 412*b* of the supporting member 410 includes a groove 418 corresponding to the rib 408 of the friction portion 404. The damping room 414 can also be filled with a cushioning medium (the principle of which can be understood with reference to FIG. 8B and will not be stated repeatedly herein).

The base 402 of the deceleration mechanism further includes at least one portion 420. The deceleration spring 422 is longitudinally connected between the at least one portion 420 and a portion (e.g., a rear portion 423) of the supporting member 410.

Figure 18:
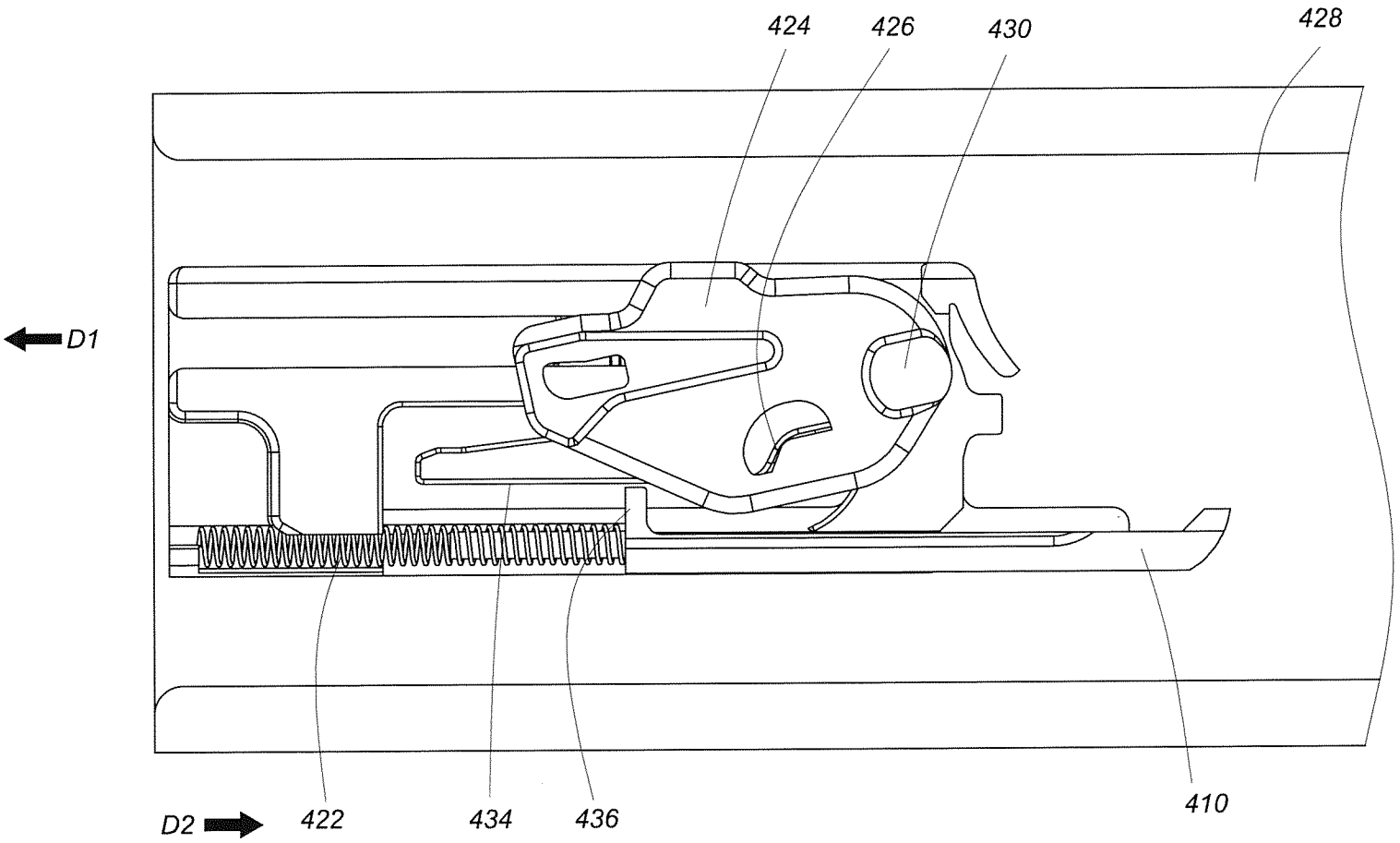
FIG. 18 is a schematic drawing in which the deceleration spring in the fourth embodiment of the present invention provides an elastic force in a direction opposite the direction of the elastic force accumulated in the elastic member.

As shown in FIG. 17 and FIG. 18, when the movable member 424 is engaged with the engaging portion 426, the deceleration spring 422 applies to the supporting member 410 an elastic force in the second direction D2 such that the supporting member 410 is retained at a certain position in response to the elastic force applied by the deceleration spring 422. If, in this state, the second rail (now shown) is retracted in the first direction D1 toward a retracted position relative to the first rail 428, the actuating portion 430 of the movable member 424 will engage with the second rail (e.g., by means of the stop portion 24 in a way similar to that shown in FIG. 13A), causing the movable member 424 to disengage from the engaging portion 426, and the elastic member 432 to release an elastic force in the first direction D1. Then, in response to the elastic force applied by the elastic member 432, the movable member 424, which has left the engaging portion 426, will be displaced along the longitudinal portion 434 in the first direction D1 and thus automatically and slowly move the second rail back to the retracted position.

During the process, the deceleration spring 422 applies to the supporting member 410 an elastic force in the second direction D2, and when the movable member 424 is pressed against the contact portion 436 of the supporting member 410 by the elastic force applied by the elastic member 432 in the first direction D1, the elastic force applied by the deceleration spring 422 serves as resistance against the elastic force applied by the elastic member 432. The movable member 424, therefore, is equally capable of moving the second rail back to the retracted position automatically and slowly.

In addition, the supporting member 410, when driven by the movable member 424, is displaced relative to the friction portion 404 and provides resistance through the friction surface 416 in the damping room 414 and the friction surface 406 of the friction portion 404. The cushioning medium filled in the damping room 414 can provide further deceleration when the second rail has been pushed relative to the first rail 428 into the last part of its retracting course.

While the present invention has been disclosed through the foregoing preferred embodiments, it is understood that the embodiments are not intended to be restrictive of the present invention. The scope of patent protection sought is defined by the appended claims.

The invention claimed is:

1. A self-closing slide rail assembly with a deceleration mechanism, comprising:

a first rail;

a second rail longitudinally displaceable relative to the first rail;

a stop portion provided at the second rail;

a self-closing mechanism mounted to the first rail such that, while the second rail is being retracted in a first direction from an extended position toward a retracted position relative to the first rail, the self-closing mechanism automatically moves the second rail back to the retracted position by means of the stop portion, the self-closing mechanism including:

a housing;

a movable member movably connected with the housing, the movable member including an actuating portion; and an elastic member for applying to the movable member an elastic force in the first direction; and the deceleration mechanism including:

a base;

a supporting member movably connected with the base, the supporting member having a portion corresponding to the movable member of the self-closing mechanism; and a deceleration spring for applying to the supporting member an elastic force in a second direction opposite the first direction, wherein the elastic force applied by the deceleration spring is less than the elastic force applied by the elastic member;

wherein while the second rail is being so operated as to be displaced in the first direction from the extended position toward the retracted position with the actuating portion of the movable member being engaged with the stop portion, the movable member drives the supporting member in response to the elastic force applied by the elastic member such that, with the elastic force applied by the deceleration spring that is able to counteract the elastic force applied by the elastic member, the movable member automatically and slowly moves the second rail back to the retracted position;

wherein the base includes a first longitudinal section; the first longitudinal section at least includes a first wall, a second wall, a front wall, a rear wall and a bottom wall extending between the first wall of the base and the second wall of the base; the first wall, the second wall, the front wall, the rear wall, and the bottom wall define a damping room; the supporting member further has a friction portion movably corresponding to the damping room of the base; and at least one of the first longitudinal section and the friction portion of the supporting member further includes a friction surface such that, when the supporting member is driven by the movable member, the friction portion of the supporting member is displaced relative to the damping room of the base and resistance is provided by the friction surface.

2. The self-closing slide rail assembly with the deceleration mechanism as claimed in claim 1, wherein the base further includes a second longitudinal section; the second longitudinal section has a longitudinal channel and a wall surface adjacent to the longitudinal channel; the supporting member of the deceleration mechanism further has an auxiliary portion; and the auxiliary portion has a hook section, is located in the longitudinal channel, and is hooked to the wall surface through the hook section.

3. The self-closing slide rail assembly with the deceleration mechanism as claimed in claim 2, wherein the auxiliary portion is configured to be pressed against an end wall of the longitudinal channel in response to the elastic force applied to the supporting member by the deceleration spring.

4. The self-closing slide rail assembly with the deceleration mechanism as claimed in claim 2, wherein the auxiliary portion is configured to be pressed against a rear wall of the first longitudinal section in response to the elastic force applied to the supporting member by the deceleration spring.

5. The self-closing slide rail assembly with the deceleration mechanism as claimed in claim 1, wherein the damping room is filled with a cushioning medium.

6. The self-closing slide rail assembly with the deceleration mechanism as claimed in claim 1, wherein the first rail includes a sidewall, the sidewall has a connecting section, and the deceleration spring is longitudinally connected between the connecting section and the supporting member.

7. The self-closing slide rail assembly with the deceleration mechanism as claimed in claim 1, wherein the base is connected with the housing of the self-closing mechanism.

8. A self-closing slide rail assembly with the deceleration mechanism, comprising:

a first rail;

a second rail longitudinally displaceable relative to the first rail;

a stop portion provided at the second rail;

a self-closing mechanism mounted to the first rail such that, while the second rail is being retracted in a first direction from an extended position toward a retracted position relative to the first rail, the self-closing mechanism automatically moves the second rail back to the retracted position by means of the stop portion, the self-closing mechanism including:

a housing;

a movable member movably connected with the housing, the movable member including an actuating portion; and an elastic member for applying to the movable member an elastic force in the first direction; and the deceleration mechanism including:

a base;

a supporting member movably connected with the base, the supporting member having a portion corresponding to the movable member of the self-closing mechanism; and a deceleration spring for applying to the supporting member an elastic force in a second direction opposite the first direction, wherein the elastic force applied by the deceleration spring is less than the elastic force applied by the elastic member;

wherein while the second rail is being so operated as to be displaced in the first direction from the extended position toward the retracted position with the actuating portion of the movable member being engaged with the stop portion, the movable member drives the supporting member in response to the elastic force applied by the elastic member such that, with the elastic force applied by the deceleration spring that is able to counteract the elastic force applied by the elastic member, the movable member automatically and slowly moves the second rail back to the retracted position;

wherein the deceleration mechanism further includes a supporting portion connected to the base; the supporting member further includes a retainer and a connecting portion, the connecting portion being connected between the supporting portion and the retainer; the deceleration spring is mounted to the connecting portion and pressed between the supporting portion and the retainer; and one of the supporting portion and the retainer has an aperture through which the connecting portion extends.

9. A self-closing slide rail assembly with the deceleration mechanism, comprising:

a first rail;

a second rail longitudinally displaceable relative to the first rail;

a stop portion provided at the second rail;

a self-closing mechanism mounted to the first rail such that, while the second rail is being retracted in a first direction from an extended position toward a retracted position relative to the first rail, the self-closing mechanism automatically moves the second rail back to the retracted position by means of the stop portion, the self-closing mechanism including:

a housing;

a movable member movably connected with the housing, the movable member including an actuating portion; and an elastic member for applying to the movable member an elastic force in the first direction; and the deceleration mechanism including:

a base;

a supporting member movably connected with the base, the supporting member having a portion corresponding to the movable member of the self-closing mechanism; and a deceleration spring for applying to the supporting member an elastic force in a second direction opposite the first direction, wherein the elastic force applied by the deceleration spring is less than the elastic force applied by the elastic member;

wherein while the second rail is being so operated as to be displaced in the first direction from the extended position toward the retracted position with the actuating portion of the movable member being engaged with the stop portion, the movable member drives the supporting member in response to the elastic force applied by the elastic member such that, with the elastic force applied by the deceleration spring that is able to counteract the elastic force applied by the elastic member, the movable member automatically and slowly moves the second rail back to the retracted position;

wherein the base includes a friction portion; the supporting member is movably connected with the friction portion; the supporting member includes a first wall, a second wall, and a bottom wall extending between the first wall of the supporting member and the second wall of the supporting member; the first wall of the supporting member, the second wall of the supporting member, and the bottom wall of the supporting member define a damping room movably corresponding to the friction portion of the base; and at least one of the supporting member and the friction portion of the base further includes a friction surface such that, when driven by the movable member, the supporting member is displaced relative to the friction portion of the base and resistance is provided by the friction surface.

10. The self-closing slide rail assembly with the deceleration mechanism as claimed in claim 9, wherein the deceleration spring is longitudinally connected between a portion of the base of the deceleration mechanism and the supporting member.

11. The self-closing slide rail assembly with the deceleration mechanism as claimed in claim 9, wherein the base is connected with the housing of the self-closing mechanism.

12. A self-closing slide rail assembly with the deceleration mechanism, comprising:

a first rail;

a second rail longitudinally displaceable relative to the first rail;

a stop portion provided at the second rail;

a self-closing mechanism mounted to the first rail such that, while the second rail is being retracted in a first direction from an extended position toward a retracted position relative to the first rail, the self-closing mechanism automatically moves the second rail back to the retracted position by means of the stop portion, the self-closing mechanism including:

a housing;

a movable member movably connected with the housing, the movable member including an actuating portion; and an elastic member for applying to the movable member an elastic force in the first direction; and the deceleration mechanism including:

a base;

a supporting member movably connected with the base, the supporting member having a portion corresponding to the movable member of the self-closing mechanism; and a deceleration spring for applying to the supporting member an elastic force in a second direction opposite the first direction, wherein the elastic force applied by the deceleration spring is less than the elastic force applied by the elastic member;

wherein while the second rail is being so operated as to be displaced in the first direction from the extended position toward the retracted position with the actuating portion of the movable member being engaged with the stop portion, the movable member drives the supporting member in response to the elastic force applied by the elastic member such that, with the elastic force applied by the deceleration spring that is able to counteract the elastic force applied by the elastic member, the movable member automatically and slowly moves the second rail back to the retracted position;

wherein the housing includes a front end portion, a rear end portion, a longitudinal room extends between the front end portion and the rear end portion, and a longitudinal portion parallel to the longitudinal room; the elastic member is mounted in the longitudinal room; the movable member further includes a first side and a second side opposite the first side, the first side having a first projection and a second projection, the second side including the actuating portion, the first projection corresponding to and being pressed by the elastic member, the second projection being pressed against the longitudinal portion; and the movable member is able to respond to the elastic force applied by the elastic member in such a way that the first projection of the movable member is displaced in the longitudinal room of the housing while the second projection of the movable member is displaced along the longitudinal portion of the housing.

13. The self-closing slide rail assembly with the deceleration mechanism as claimed in claim 12, wherein the housing further includes an engaging portion extending transversely from the longitudinal portion.

14. The self-closing slide rail assembly with the deceleration mechanism as claimed in claim 12, wherein the housing further includes a stop wall adjacent to the rear end portion, and the second projection of the movable member corresponds to the stop wall of the housing.

* * * * *